US009428938B2

(12) United States Patent
Taylor et al.

(10) Patent No.: US 9,428,938 B2
(45) Date of Patent: Aug. 30, 2016

(54) MERCHANDISE SECURITY DEVICES FOR USE WITH AN ELECTRONIC KEY

(71) Applicant: InVue Security Products Inc., Charlotte, NC (US)

(72) Inventors: Gary A. Taylor, Fort Mill, SC (US); Jeffrey A. Grant, Charlotte, NC (US); David N. Berglund, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 14/824,205

(22) Filed: Aug. 12, 2015

(65) Prior Publication Data

US 2015/0345183 A1 Dec. 3, 2015

Related U.S. Application Data

(63) Continuation of application No. 14/328,051, filed on Jul. 10, 2014, now Pat. No. 9,133,649.

(60) Provisional application No. 61/845,392, filed on Jul. 12, 2013, provisional application No. 61/891,061, filed on Oct. 15, 2013, provisional application No. 61/902,900, filed on Nov. 12, 2013, provisional application No. 61/904,479, filed on Nov. 15, 2013, provisional application No. 61/924,321, filed on Jan. 7, 2014, provisional application No. 61/973,314, filed on Apr. 1, 2014.

(51) Int. Cl.
*E05B 47/00* (2006.01)
*E05B 73/00* (2006.01)
(Continued)

(52) U.S. Cl.
CPC ..... *E05B 47/0009* (2013.01); *E05B 15/16* (2013.01); *E05B 47/0001* (2013.01); *E05B 51/005* (2013.01); *E05B 67/00* (2013.01); *E05B 67/10* (2013.01); *E05B 73/00* (2013.01); *E05B 73/0017* (2013.01); *E05B 73/0023* (2013.01); *E05B 73/0047* (2013.01); *E05B 2047/0063* (2013.01); *E05B 2047/0082* (2013.01); *E05B 2047/0083* (2013.01); *E05B 2047/0084* (2013.01); *Y10T 70/413* (2015.04)

(58) Field of Classification Search
CPC .... E05B 15/16; E05B 19/0088; E05B 47/00; E05B 47/0001; E05B 47/0009; E05B 2047/0063; E05B 2047/0072; E05B 2047/0073; E05B 2047/0082; E05B 2047/0083; E05B 2047/0084; E05B 2047/0088; E05B 51/005
See application file for complete search history.

(56) References Cited

U.S. PATENT DOCUMENTS 3,901,057 A 8/1975 Coley, Sr.
3,979,647 A 9/1976 Perron et al.
(Continued)

FOREIGN PATENT DOCUMENTS

WO 0061899 A1 10/2000
WO 2008034022 A2 3/2008
WO 2013008257 A1 1/2013

OTHER PUBLICATIONS

"Instant security for standard commodity hooks", 2013, 4 pages, InVue Security Products Inc., Charlotte, NC, USA.
(Continued)

*Primary Examiner* — Christopher Boswell
(74) *Attorney, Agent, or Firm* — InVue Security Products Inc.

(57) ABSTRACT

A merchandise security device is provided. The merchandise security device may include a lock mechanism operably engaged with a shape memory material configured to receive electrical power for locking and unlocking the lock mechanism. The shape memory material may be configured to change in shape in response to receiving electrical power to thereby lock or unlock the lock mechanism.

20 Claims, 22 Drawing Sheets

(51) Int. Cl.

| | |
|---|---|
| ***E05B 67/00*** | (2006.01) |
| ***E05B 15/16*** | (2006.01) |
| ***E05B 51/00*** | (2006.01) |
| ***E05B 67/10*** | (2006.01) |

(56) References Cited

U.S. PATENT DOCUMENTS 4,031,434 A 6/1977 Perron et al.
5,147,034 A 9/1992 Broadhead et al.
5,351,042 A 9/1994 Aston
5,509,528 A 4/1996 Weisburn
5,598,728 A 2/1997 Lax
5,636,737 A 6/1997 Marsilio
5,760,689 A 6/1998 Holmgren
5,762,187 A 6/1998 Belden, Jr. et al.
5,782,350 A 7/1998 Weisburn et al.
5,868,013 A 2/1999 Julien
5,905,446 A 5/1999 Benore et al.
5,984,388 A 11/1999 Bacon
6,008,992 A 12/1999 Kawakami
6,073,469 A 6/2000 Julien
6,082,153 A 7/2000 Schoell et al.
6,209,367 B1 4/2001 Hyatt, Jr. et al.
6,227,020 B1 5/2001 Lerchner
6,285,286 B1 9/2001 Tyrén et al.
6,310,411 B1 10/2001 Viallet
6,331,812 B1 12/2001 Dawalibi
6,354,435 B1 3/2002 Belden, Jr. et al.
6,412,631 B2 7/2002 Belden, Jr. et al.
6,422,387 B1 7/2002 Sedon et al.
6,450,725 B1 9/2002 Roth et al.
6,474,470 B2 11/2002 Byrne et al.
6,474,478 B1 11/2002 Huehner et al.
6,485,081 B1 11/2002 Bingle et al.
6,496,101 B1 12/2002 Stillwagon
6,497,125 B1 12/2002 Necchi
6,561,347 B1 5/2003 Lax
6,588,243 B1 7/2003 Hyatt, Jr. et al.
6,598,742 B1 7/2003 Belden, Jr. et al.
6,601,701 B1 8/2003 Belden, Jr. et al.
6,601,702 B2 8/2003 Byrne et al.
6,626,290 B2 9/2003 Byrne et al.
6,659,291 B2 12/2003 Huehner et al.
6,666,330 B2 12/2003 Sedon et al.
6,688,463 B2 2/2004 Peterson et al.
6,731,212 B2 5/2004 Hirose et al.
6,832,498 B2 12/2004 Belden, Jr. et al.
6,871,519 B2 3/2005 Butera et al.
6,926,164 B1 8/2005 Broadhead et al.
6,938,758 B2 9/2005 Marsilio et al.
6,951,278 B2 10/2005 Pettigrew et al.
6,957,555 B1 10/2005 Nagel et al.
6,966,438 B2 11/2005 Belden, Jr. et al.
6,997,311 B2 2/2006 Sankey et al.
7,000,441 B2 2/2006 Sutton et al.
7,007,810 B2 3/2006 Huehner et al.
7,029,056 B2 4/2006 Browne
7,066,325 B2 6/2006 Bird et al.
7,099,474 B1 8/2006 Liden et al.
7,100,402 B2 9/2006 Holmgren
7,131,542 B2 11/2006 Sedon et al.
7,140,489 B2 11/2006 Lax et al.
7,167,096 B2 1/2007 Marsilio et al.
7,194,879 B2 3/2007 Sedon et al.
7,194,880 B2 3/2007 Necchi
7,215,250 B2 5/2007 Hansen et al.
7,243,800 B1 7/2007 Feibelman
7,260,962 B2 8/2007 Lax et al.
7,269,983 B1 9/2007 McHatet
7,320,235 B2 1/2008 Belden, Jr. et al.
7,344,025 B2 3/2008 Belden, Jr. et al.
7,380,711 B2 6/2008 Simon et al.
7,380,843 B2 6/2008 Alacqua et al.
7,392,673 B2 7/2008 Fawcett et al.
7,406,846 B2 8/2008 Chu
7,456,745 B2 11/2008 Marsilio et al.
7,484,389 B2 2/2009 Sedon et al.
7,500,704 B2 * 3/2009 Herrera ..... E05B 47/0009 296/37.12
7,552,822 B2 6/2009 Belden, Jr. et al.
7,581,418 B2 9/2009 Sedon et al.
7,581,419 B2 9/2009 Belden, Jr. et al.
7,581,708 B2 9/2009 Kennedy et al.
7,598,861 B2 10/2009 Belden, Jr. et al.
7,610,783 B2 11/2009 Rudduck
7,614,265 B2 11/2009 Belden, Jr. et al.
7,617,703 B2 11/2009 Osvatic
7,625,019 B2 12/2009 Alacqua et al.
7,665,603 B2 2/2010 Leesberg
7,690,231 B1 4/2010 Field
7,703,308 B2 4/2010 Nagelski
7,837,051 B2 11/2010 Broadhead et al.
7,870,766 B2 1/2011 Sedon et al.
7,878,389 B2 2/2011 Rudduck et al.
7,924,154 B2 4/2011 Belden, Jr. et al.
7,963,131 B2 6/2011 Zhang et al.
7,966,851 B2 6/2011 Sedon et al.
7,992,711 B2 8/2011 Belden, Jr. et al.
7,999,672 B1 8/2011 Fiebelman
8,016,147 B2 9/2011 Broadhead et al.
8,061,514 B2 11/2011 Necchi
8,207,849 B2 6/2012 Belden, Jr. et al.
8,276,410 B2 10/2012 Sedon et al.
8,286,454 B2 10/2012 Richardson et al.
8,286,565 B2 10/2012 Valiulis et al.
8,325,039 B2 12/2012 Picard et al.
8,341,958 B2 1/2013 Brown et al.
8,341,987 B2 1/2013 Nagelski
8,376,150 B2 2/2013 Surma et al.
8,419,083 B2 * 4/2013 Burmesch ..... E05B 47/0012 292/144
8,528,373 B2 * 9/2013 Hyatt, Jr. ..... E05B 47/0002 340/5.52
8,542,119 B2 9/2013 Sankey
9,347,609 B2 * 5/2016 Pinto, IV ..... E05B 47/0009
2004/0027236 A1 2/2004 Zhai
2004/0160305 A1 8/2004 Remenih et al.
2005/0183479 A1 8/2005 Alacqua et al.
2005/0252260 A1 11/2005 Chu
2007/0131005 A1 6/2007 Clare
2007/0132551 A1 6/2007 Mozer
2007/0296545 A1 12/2007 Clare
2008/0184355 A1 7/2008 Walrath et al.
2008/0231154 A1 * 9/2008 Rudduck ..... E05B 17/0037 312/333
2008/0272606 A1 11/2008 Alacqua et al.
2009/0013736 A1 1/2009 Voosen
2009/0217717 A1 9/2009 Mrkovic et al.
2009/0229321 A1 9/2009 Eccles et al.
2009/0230275 A1 9/2009 Lawall et al.
2009/0230700 A1 9/2009 Arabia et al.
2009/0273440 A1 11/2009 Marschalek et al.
2009/0322531 A1 12/2009 Estevez et al.
2010/0097223 A1 4/2010 Kruest et al.
2010/0102572 A1 * 4/2010 Burmesch ..... E05B 47/0012 292/64
2010/0133126 A1 6/2010 Shute et al.
2010/0170310 A1 7/2010 Ivashin et al.
2010/0175438 A1 7/2010 Sankey
2010/0229610 A1 9/2010 Garrigan et al.
2010/0236306 A1 9/2010 Trempala et al.
2010/0300159 A1 12/2010 Berg et al.
2010/0320103 A1 12/2010 Nilsson
2011/0084799 A1 4/2011 Ficko
2011/0254661 A1 10/2011 Fawcett et al.
2011/0259063 A1 10/2011 Foti
2012/0043228 A1 2/2012 Ezzo et al.
2012/0047972 A1 3/2012 Grant et al.

(56) References Cited

U.S. PATENT DOCUMENTS

| | | | |
|---|---|---|---|
| 2012/0085757 | A1 | 4/2012 | Will et al. |
| 2012/0112912 | A1 | 5/2012 | Berg |
| 2012/0228290 | A1 | 9/2012 | Conti |
| 2013/0081434 | A1 | 4/2013 | Grant et al. |
| 2013/0152646 | A1 | 6/2013 | Field |
| 2013/0213100 | A1 | 8/2013 | Cohen |
| 2015/0013398 | A1 | 1/2015 | Taylor et al. |

OTHER PUBLICATIONS

Lee W. Young, "Notification of Transmittal of the International Search Report and the Written Opinion of the International Searching Authority, or the Declaration" for International Patent Application No. PCT/US2014/046158 filed Jul. 10, 2014, Jan. 16, 2015, pp. 1-10, Commissioner for Patents, Alexandria, Virginia USA.

* cited by examiner

MERCHANDISE SECURITY DEVICES FOR USE WITH AN ELECTRONIC KEY

CROSS REFERENCE TO RELATED APPLICATIONS

This application is a continuation of U.S. application Ser. No. 14/328,051 filed on Jul. 10, 2014 and claims the benefit of the filing dates of U.S. Provisional Application No. 61/845,392 filed on Jul. 12, 2013, U.S. Provisional Application No. 61/891,061 filed on Oct. 15, 2013, U.S. Provisional Application No. 61/902,900 filed on Nov. 12, 2013, U.S. Provisional Application No. 61/904,479 filed on Nov. 15, 2013, U.S. Provisional Application No. 61/924,321 filed on Jan. 7, 2014, and U.S. Provisional Application No. 61/973,314 filed on Apr. 1, 2014, the disclosures of which are incorporated herein by reference in their entireties.

FIELD OF THE INVENTION

Embodiments of the present invention relate generally to merchandise display security systems and methods for protecting an item of merchandise from theft. More particularly, embodiments of the present invention relate to merchandise security devices configured for use with an electronic key.

BACKGROUND OF THE INVENTION

It is common practice for retailers to store and/or display relatively expensive items of merchandise on or within a merchandise security device, such as a security display (e.g. alarming stand), security fixture (e.g. locking hook, shelf, cabinet, etc.) or security packaging (e.g. merchandise safer). Regardless, the merchandise security device displays and/or stores an item of merchandise so that a potential purchaser may view, and in some instances, interact with the merchandise before making a decision whether to purchase the item. At the same time, the item is secured on or within the merchandise security device so as to prevent, or at least deter, theft of the item. The value of the item, however, may make it an attractive target for a shoplifter despite the presence of a merchandise security device. A determined shoplifter may attempt to detach the item from the security display, or attempt to remove the item from the security fixture or from the security packaging. Alternatively, the shoplifter may attempt to remove the security device, or at least a portion thereof, from the display area along with the item.

In the case of a security display or security fixture, the security device is oftentimes firmly attached to a support, such as a pegboard, wire grid, horizontal bar rack, slatwall (also known as slatboard), wall, table, desk, countertop or like structure. In some instances, the security device is secured to the support using a mechanical lock mechanism, for example a conventional tumbler lock or a magnetic lock, operated by a non-programmable key. In other instances, the security device is secured to the support using an electronic lock mechanism operated by a programmable electronic key.

Some types of security devices are configured to operate with only a mechanical key, and as a result, may be less secure than security devices that operate with an electronic key. Accordingly, there exists a need for an improved merchandise security device configured for use with an electronic key.

SUMMARY OF THE INVENTION

In one aspect, the invention is embodied by a merchandise security device for protecting items of merchandise from theft. The merchandise security device includes a lock mechanism operably engaged with a shape memory material configured to receive electrical power for locking and unlocking the lock mechanism. The shape memory material is configured to change in shape in response to the at least one conductor receiving electrical power to thereby lock or unlock the lock mechanism. The merchandise security device may also include at least one electrical conductor operably engaged with the lock mechanism and in electrical communication with the shape memory material. In one embodiment, the at least one conductor is configured to receive electrical power inductively. In another embodiment, the at least one conductor includes a coil having a plurality of continuous windings. In another embodiment, the shape memory material includes a wire in electrical communication with the at least one conductor and is configured to change in length in response to the at least one conductor receiving electrical power. In some embodiments, the merchandise security device does not include a rectifier, a battery, and/or a logic control circuit to facilitate locking or unlocking thereof.

In other aspects, the merchandise security device further includes a housing defining an enclosure configured to receive the item of merchandise therein and a lid engaged with the housing and configured to move between open and closed positions relative to the housing. The lock mechanism is operably engaged with the lid or the housing and is operable to lock the lid to the housing in the closed position. Moreover, the shape memory material is configured to change in shape in response to receiving electrical power for unlocking the lid from the housing so that the item of merchandise may be removed from the housing in the open position. In one aspect, the lock mechanism is operably engaged with the lid. The merchandise security device may include a transfer port on the lid or the housing that is operably engaged with the shape memory material, wherein the transfer port is configured to receive electrical power and transfer the power to the at least one electrical conductor. In another aspect, the merchandise security device includes a locking hook comprising at least one rod for supporting items of merchandise and a housing configured to releasably engage the at least one rod in response to actuation of the lock mechanism. In yet another aspect, the merchandise security device includes a housing configured to releasably engage, and be removed from, at least one rod for supporting items of merchandise in response to actuation of the lock mechanism.

In another aspect, the invention is embodied by merchandise security system for protecting an item of merchandise from theft that is configured for use with an electronic key. The merchandise security system includes an electronic key, and a merchandise security device comprising a lock mechanism that is operated by electrical power transferred from the electronic key to the lock mechanism. The lock mechanism is operably engaged with a shape memory material that is configured to change in shape in response to receiving electrical power to thereby lock or unlock the lock mechanism. In one embodiment, the electronic key is configured to transfer power inductively to the lock mechanism. In another embodiment, the electronic key is configured to time out after a predetermined period of time. In another embodiment the merchandise security device does not include a rectifier, a battery, and/or a logic control circuit to facilitate locking or unlocking thereof. In one aspect, the merchandise security system includes a transfer port operably engaged with the merchandise security device, wherein the at least one conductor is disposed adjacent to the transfer port, and wherein the transfer port is configured to receive electrical power from the electronic key and transfer the power to the shape memory material.

In yet another aspect, the invention is embodied by a method for protecting an item of merchandise susceptible to theft. The method includes receiving electrical power from an electronic key at a lock mechanism, and locking or unlocking the lock mechanism in response to a change in shape of a shape memory material operably engaged with the lock mechanism. In another embodiment, the method includes receiving electrical power inductively. In another embodiment, the method includes receiving a wireless security signal prior to receiving electrical power at the lock mechanism. In another embodiment receiving electrical power includes receiving electrical power only when no return signal is provided by the lock mechanism in response to receiving the wireless security signal. In another embodiment, locking or unlocking includes locking or unlocking a lid to a housing configured to receive the item of merchandise therein. In another embodiment, locking or unlocking comprises locking or unlocking a housing to a rod configured to support items of merchandise thereon.

In another embodiment, a lockable enclosure for securing an item of merchandise from theft is provided. The lockable enclosure includes a housing defining an enclosure configured to receive the item of merchandise therein and a lid engaged with the housing and configured to move between open and closed positions relative to the housing. The lockable enclosure also includes a lock mechanism operably engaged with the lid or the housing, the lock mechanism operable to lock the lid to the housing in the closed position, and a shape memory material operably engaged with the lock mechanism and configured to change in shape in response to receiving electrical power for unlocking the lid from the housing so that the item of merchandise may be removed from the housing in the open position.

In one embodiment, a merchandise security assembly is provided and includes an electronic key and a lockable enclosure comprising a lock mechanism that is operated by electrical power transferred from the electronic key to the lock mechanism. The lockable enclosure includes a housing configured to receive an item of merchandise and a lid configured to be locked to the housing with the lock mechanism. The lock mechanism is operably engaged with a shape memory material that is configured to change in shape in response to receiving electrical power from the electronic key to thereby lock or unlock the lock mechanism.

In another embodiment, a method for securing an item of merchandise from theft is provided. The method includes positioning an item of merchandise within a housing and closing a lid relative to the housing such that the item of merchandise is enclosed within the housing and the lid is locked to the housing with a lock mechanism. The method further includes actuating the lock mechanism with electrical power to unlock the lid from the housing in response to a change in shape of a shape memory material operably engaged with the lock mechanism to facilitate removal of the item of merchandise from the housing.

In an additional embodiment, a method of manufacturing a lockable for securing an item of merchandise from theft is provided. The method includes forming a housing defining an enclosure configured to receive the item of merchandise therein and forming a lid configured to engage with the housing and move between open and closed positions relative to the housing. The method further includes attaching a lock mechanism to the lid or the housing, the lock mechanism operable to lock the lid to the housing in the closed position. The lock mechanism comprises a shape memory material operably engaged with the lock mechanism and configured to change in shape in response to receiving electrical power for unlocking the lid from the housing so that the item of merchandise may be removed from the housing in the open position.

BRIEF DESCRIPTION OF THE DRAWINGS

The detailed description of the invention provided below may be better understood with reference to the accompanying drawing figures, which depict embodiments of an electronic key and a merchandise security device configured for use with an electronic key.

DETAILED DESCRIPTION OF EMBODIMENTS OF THE INVENTION

Figure 1:
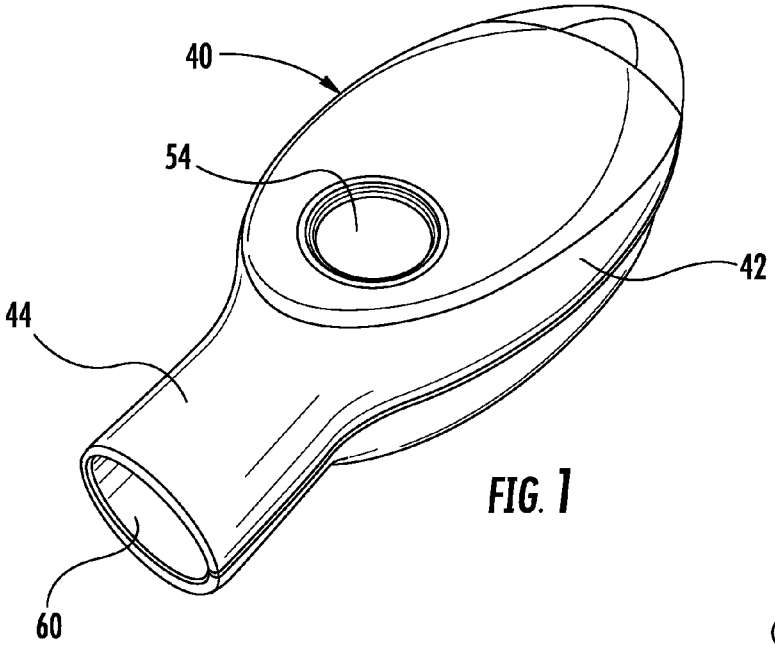
FIG. 1 is a right side perspective view of an electronic key according to an exemplary embodiment of the invention.

Referring now to the accompanying drawing figures wherein like reference numerals denote like elements throughout the various views, one or more embodiments of a merchandise display security system and method are shown. In the exemplary embodiments shown and described herein, the system includes an electronic key and a merchandise security device configured for use with the electronic key. Merchandise security devices suitable for use with an electronic key include, but are not limited to, a security display (e.g. alarming stand or module), security fixture (e.g. locking hook, shelf, cabinet, etc.), security wraps or cables, garment tags, or security packaging (e.g. merchandise safer) for securing an item of merchandise from theft. The electronic key may be useable with any security device that utilizes power transferred from the key to operate a mechanical lock mechanism associated with the security device, and/or utilizes data transferred from the key to authorize the operation of a mechanical lock mechanism or an electronic alarm circuit. In other words, an electronic key according to embodiments of the invention is useable with any security device or lock mechanism that requires power transferred from the key to the device and/or data transferred between the key and the device. Further examples of security devices include, but are not limited to, a door lock, a drawer lock or a shelf lock, as well as any device that prevents an unauthorized person from accessing, removing or detaching an item from a secure location or position.

It should be noted that although the invention is described with respect to embodiments including an electronic key for transferring both data and power to a merchandise security device to operate a mechanical lock mechanism, the invention is equally applicable to an electronic key for transferring only electrical power to a merchandise security device to operate any component of the merchandise security device (e.g., a lock mechanism, alarm circuit, etc.), whether or not the security device includes an internal or external power source for operating another component of the device.

One embodiment of an electronic key for use with a merchandise display security system and method according to the invention is shown in FIGS. 1-6 and will be described in greater detail hereinafter. The merchandise display security system and method comprises the electronic key and a merchandise security device that is configured to be operated with the key. The system and method may further comprise an optional programming station that is operable for programming the electronic key with a security code, which is also referred to herein as a Security Disarm Code (SDC). A programming station suitable for use with the electronic key is shown and described in U.S. Pat. No. 7,737,844 entitled Programming Station For a Security System For Protecting Merchandise, the disclosure of which is incorporated herein by reference in its entirety. It is to be understood that in other embodiments the electronic key may be programmed without the use of a programming station. For example, the key may be self-programming, input by a user, or may be pre-programmed with a predetermined SDC.

In addition to the programming station, the system and method may further comprise an optional charging station that is operable for initially charging and/or subsequently recharging an internal power source disposed within the key. The electronic key may be provisioned with a single-use (i.e. non-rechargeable) power source, such as a conventional or extended-life battery, or alternatively, the key may be provisioned with a multiple-use (i.e. rechargeable) power source, such as a conventional capacitor or rechargeable battery. In either instance, the internal power source may be permanent, semi-permanent (i.e. replaceable), or rechargeable, as desired. In the latter instance, the charging station is provided to initially charge and/or to subsequently recharge the internal power source disposed within the electronic key.

In certain embodiments, the merchandise security device is a passive device. As used herein, the term "passive" is intended to mean that the security device does not have an internal power source (e.g., a battery) sufficient to lock and/or unlock a mechanical lock mechanism. Significant cost savings are obtained by a retailer when the merchandise security device is passive since the expense of an internal power source is confined to the electronic key, and one such key is able to operate multiple security devices. In addition, the security device may not require an electric motor, such as a DC stepper motor, solenoid, or the like, that is configured to lock or unlock the lock mechanism. As such, the security device may employ a simplified lock mechanism that does not require various components operated by its own source of electrical power.

Moreover, in certain embodiments the merchandise security device is not required to include a logic control circuit, while the electronic key includes such a logic control circuit. In this regard, some security devices include a logic control circuit adapted to perform a handshake communication protocol with the logic control circuit of the electronic key (e.g., using an SDC). Thus, the security device may or may not include a logic control circuit used to communicate with the electronic key in order to determine whether the merchandise security device is an authorized device. Likewise, the electronic key may or may not include a logic control circuit. Regardless of whether the electronic key includes a logic control circuit, an SDC may be unnecessary where the electronic key configured to transmit power to the security device is not readily duplicated by a potential thief. For example, where the electronic key is configured to transmit power inductively, the inductive signature may provide increased security relative to conventional lock mechanisms that utilize mechanical or magnetic actuators. For instance, the electronic key may be configured to transmit an inductive signature including a particular amplitude and/or frequency of a power signal that is not readily apparent to, or is not readily able to be duplicated by, a potential thief.

In some embodiments, the electronic key does not transmit an SDC to the security device. However, in other embodiments, the electronic key may be configured to transmit an SDC to the security device. In the latter embodiments, the security device may include a corresponding SDC. Thus, the electronic key may be configured to perform a handshake communication protocol with the security device. In the event that the SDC of the electronic key matches the SDC of the security device, the electronic key may then be configured to transmit electrical power to the security device.

However in other embodiments, the security device may not recognize the SDC transmitted by the electronic key, such as where the security device does not include a logic control circuit or a component including an SDC. If the electronic key does not receive a return signal from the security device, the electronic key may nevertheless still transmit electrical power to the security device as described in further detail below. Thus, although the electronic key may transmit an SDC to the security device, the security device may not recognize or even receive the SDC and the SDC transmitted by the electronic key will not affect the operation of the security device. As will be readily apparent to those skilled in the art, the SDC may be transmitted from the electronic key to the merchandise security device by any suitable means, including without limitation, via one or more electrical contacts, or via optical, acoustic, electromechanical, electromagnetic or magnetic conductors, as desired. In certain embodiments, the SDC may be transmitted by inductive transfer of data from the electronic key to the merchandise security device.

In one embodiment, the logic control circuit of the electronic key is configured to cause the internal power source of the key to transfer electrical power to the security device to operate a lock mechanism of the security device. In one example, electrical contacts disposed on the electronic key electrically couple with cooperating electrical contacts on the merchandise security device to transfer power from the internal battery of the key to the merchandise security device. As such, electrical power may be transferred directly to the lock mechanism via one or more conductors. For example, a conductor may be coupled to a mechanical lock mechanism and when electrical power is conducted through the conductor a state change occurs, thereby resulting in operation of the lock mechanism. In the exemplary embodiments shown and described herein, the conductor is coupled to a shape memory material (e.g., Nitinol) such that electrical power transferred through the conductor results in a change in shape of the shape memory material. Such a change in shape may cause a mechanical actuation (e.g., linear, rotary, etc.) of the lock mechanism to lock or unlock the lock mechanism. In other embodiments, the conductor may couple with a motor or solenoid for operating the lock mechanism.

An available feature of a merchandise security system and method according to an embodiment of the invention is that the electronic key may include a time-out function. More particularly, the ability of the electronic key to transfer power and/or data to the merchandise security device is deactivated after a predetermined time period. By way of example, the logic control circuit of the electronic key may be deactivated after about six to about twelve hours (e.g., about eight hours) from the time that the key was last fully charged, or last programmed or refreshed by the programming station. In this manner, an authorized sales associate typically must charge, program, re-program or refresh an electronic key assigned to him or her at the beginning of each work shift. Furthermore, the charging station may be configured to deactivate the logic control circuit of the key when the key is positioned within the charging station. In this manner, the charging station can be made available to an authorized sales associate in an unsecured location without risk that a charged key could be removed from the charging station and used to disarm and/or unlock a merchandise security device in an unauthorized manner. The electronic key would then have to be programmed, re-programmed or refreshed by the programming station, which is typically monitored or maintained at a secure location, in order to reactivate the logic control circuit of the key.

The merchandise security device may include a transfer port sized and shaped to receive a transfer probe of the electronic key. At least one, and sometimes, a plurality of magnets may be disposed within the transfer port for securely positioning and retaining the transfer probe of the key in physical contact with the transfer port of the merchandise security device. In certain embodiments, the magnet(s) securely retain one or more electrical contacts of the electronic key in electrical contact with one or more electrical contacts of the mechanical lock mechanism of the security device. In this instance, electrical power is transferred from the electronic key to the security device through the one or more electrical contacts disposed on the transfer probe of the key and the corresponding electrical contacts disposed within the transfer port of the security device.

Exemplary embodiments of a merchandise display security system and method according to the invention shown and described herein comprise an electronic key with inductive transfer capability and a merchandise security device that is configured to be operated by the key. However, the electronic key is useable with any security device or locking device with inductive transfer capability that requires power transferred from the key to the device by induction, or alternatively, requires data transferred between the key and the device and power transferred from the key to the device by induction. Examples of such security devices include, but are not limited to, locking hooks, a door lock, a drawer lock or a shelf lock, as well as any device that prevents an unauthorized person from accessing, removing or detaching an item from a secure location or position. The merchandise display system and method may further comprise an optional programming station, as previously described, operable for programming the electronic key with an SDC. In addition to a programming station, the system and method may further comprise an optional charging station with electrical contact and/or inductive transfer capability that is operable for initially charging and subsequently recharging an internal power source disposed within the key.

In certain embodiments, the security device comprises an internal lock mechanism. A transfer port may be formed in the security device that is sized and shaped to receive a transfer probe or a portion of the electronic key. If desired, the transfer port may comprise mechanical or magnetic means for properly positioning and securely retaining the key within the transfer port. In one instance, it is necessary that an inductive transceiver of the electronic key is sufficiently aligned or proximate to a corresponding inductive transceiver of the security device. In another instance, it is only necessary that the transfer probe is proximate to the transfer port. Therefore, magnets are not required to position, align, retain and/or maintain the transfer probe of the electronic key in physical and/or electrical contact with the transfer port provided on the security device.

In some embodiments, data may be transferred from the electronic key to the security device by wireless communication, such as infrared (IR) optical transmission. Power may be transferred from the electronic key to the security device by induction across the transfer port of the security device using an inductive transceiver disposed within the transfer probe of the key that cooperates with a corresponding inductive transceiver disposed within the security device. For example, the transfer probe of the electronic key may comprise an inductive transceiver coil that is electrically connected to the logic control circuit of the key to provide electrical power from the internal battery of the key to an inductive transceiver coil disposed within the security device. The inductive transceiver coil of the security device may then transfer the electrical power from the internal battery of the key to the lock mechanism disposed within the security device. Thus, the security device may include at least one conductor configured as a coil having a plurality of continuous windings. As previously mentioned, the power transferred from the electronic key may be used to unlock the lock mechanism without the need for various other electrically powered mechanisms, for example, an electric motor, DC stepper motor, solenoid, or the like.

According to one aspect, the electronic key does not require a physical force to be exerted by a user on the key to operate the lock mechanism of the merchandise security device. By extension, no physical force is exerted by the electronic key on the lock mechanism. As a result, the electronic key cannot be unintentionally broken off in the lock, as often occurs with conventional mechanical key and lock mechanisms. Furthermore, neither the electronic key nor the lock mechanism suffer from excessive wear as likewise often occurs with conventional mechanical key and lock mechanisms, and to a lesser extent, with electronic key and lock mechanisms having exposed electrical contacts. In addition, there is no required orientation of the transfer probe of the electronic key relative to a charging port of a charging station, a programming port of a programming station and/or the transfer port of the merchandise security device. Accordingly, any wear on the transfer probe of the key, the charging port of the charging station, the programming port of the programming station and/or the transfer port of the security device is avoided, or at the least minimized. As a further advantage, an authorized person is not required to position the transfer probe of the electronic key in a particular orientation relative to the transfer port of the security device, and thereafter exert a compressive and/or torsional force on the key to operate the mechanical lock mechanism of the security device.

FIGS. 1-6 show an electronic key 40 with inductive transfer capability according to an exemplary embodiment of the invention. As previously mentioned, the electronic key 40 is configured to transfer power and/or data to a merchandise security device that comprises a mechanical lock mechanism. Accordingly, electronic key 40 may be an active device. The term "active" is used herein to mean that an electronic key has an internal power source sufficient to cause operation of the lock mechanism of the merchandise security device. In one embodiment, the electronic key 40 may be configured to transfer both data and power from an internal source disposed within the key, for example, with a logic control circuit (e.g. data) and a battery (e.g. power).

As shown herein, the electronic key 40 comprises a housing 42 defining an internal cavity or compartment 41 (see FIG. 6) that contains the internal components of the key, including without limitation a logic control circuit, memory, communication system and battery, as will be described. As previously mentioned, the electronic key 40 further comprises a transfer probe 44 located at an end of the housing 42 for transferring data and/or power to the merchandise security device. The transfer probe 44 may also be operable to transmit and receive the handshake communication protocol and the SDC from the programming station and to receive power from the charging station.

Figure 2:
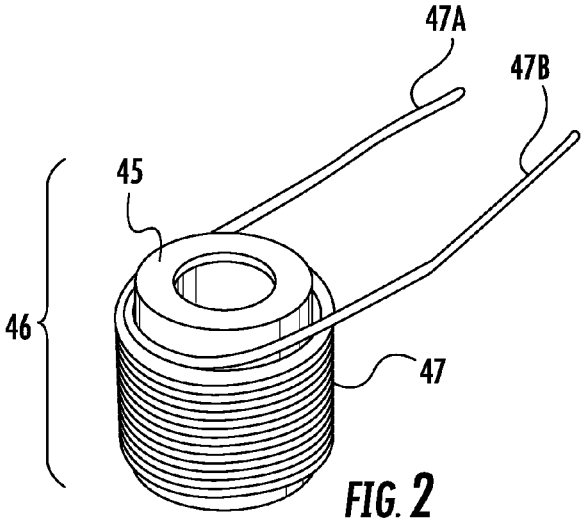
FIG. 2 is a perspective view of an inductive coil of the electronic key of FIG. 1.

FIG. 2 shows an embodiment of an inductive coil 46 having high magnetic permeability that is adapted to be disposed within the housing 42 of the electronic key 40 adjacent the transfer probe 44. As shown herein, the inductive coil 46 comprises a highly magnetically permeable ferrite core 45 surrounded by a plurality of inductive core windings 47. The inductive core windings 47 consist of a length of a conductive wire that is wrapped around the ferrite core 45. Passing an alternating current through the conductive wire generates, or induces, a magnetic field around the inductive coil 46. The alternating current in the inductive core windings 47 may be produced by connecting the leads 47A and 47B of the conductive wire to the internal battery of the electronic key 40 through the logic control circuit.

Figure 3:
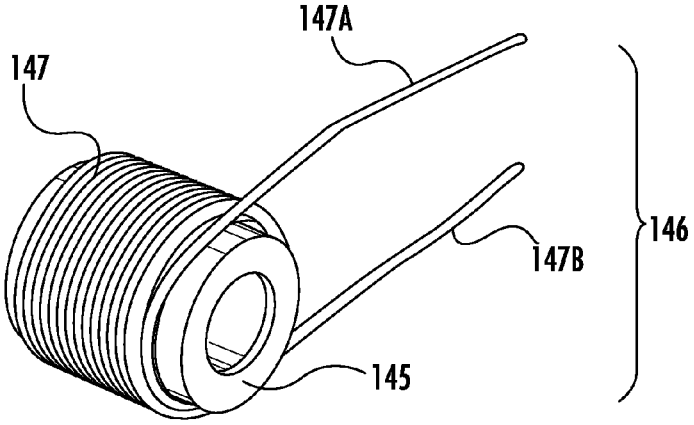
FIG. 3 is a perspective view of an inductive coil of a merchandise security device configured for use with the electronic key of FIG. 1.

FIG. 3 shows a similar inductive coil 146 that is adapted to be disposed adjacent to or within a transfer port provided on the merchandise security device. In one embodiment, the inductive coil 146 comprises a highly magnetically permeable ferrite core 145 surrounded by a plurality of inductive core windings 147 consisting of a length of a conductive wire that is wrapped around the ferrite core. Placing the transfer probe 44 of the electronic key 40 into, or adjacent to, the transfer port of the merchandise security device and passing an alternating current through the inductive core windings 47 of the inductive coil 46 generates a magnetic field within the transfer port of the security device in the vicinity of the inductive coil 146. As a result, an alternating current is generated, or induced, in the conductive wire of the inductive core windings 147 of inductive coil 146 having leads 147A and 147B that are connected to the logic control circuit of the security device and/or one or both ends of a shape memory material or wire. It is understood that depending on the placement of the inductive coil 146 relative to the transfer port of the merchandise security device (e.g., within, around, or adjacent to the transfer port), a ferrite core 145 may not be necessary in some embodiments such that the inductive core winding 147 is configured to receive current directly from the inductive coil 46. Thus, in some embodiments, the inductive coil 146 may consist of only a winding of electrically conductive material. It is understood that the core windings 147 may be disposed at any desired location relative to the transfer port, such as within, adjacent to, or at least partially around the transfer port for receiving electrical power from the key 40. For example, a plurality of core windings 147 may be wrapped about the transfer port.

Figure 6:
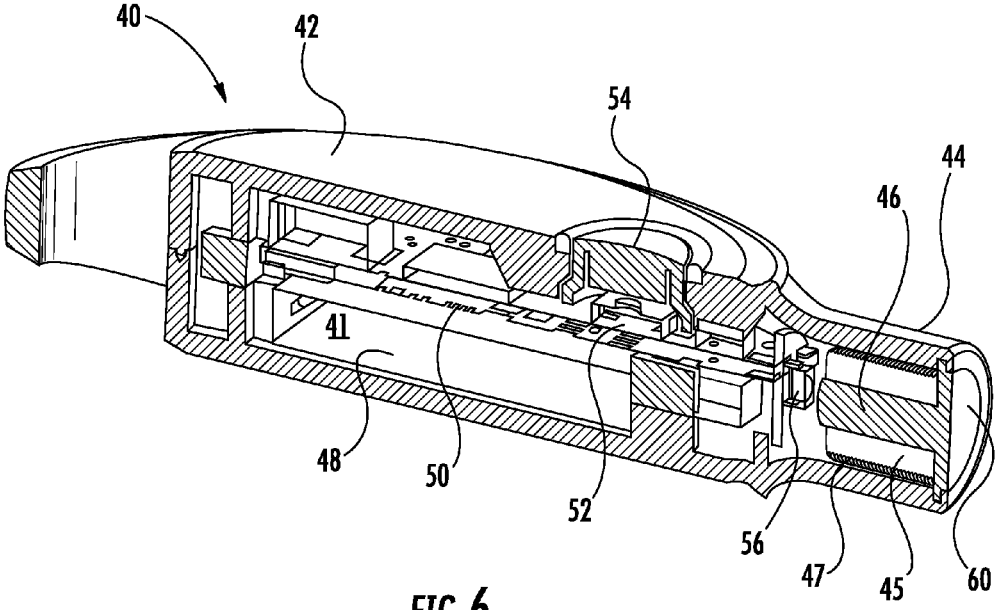
FIG. 6 is a sectional view of the electronic key of FIG. 1 showing the internal components of the key.

In one embodiment, an internal battery 48 and a logic control circuit, or printed circuit board (PCB) 50 are disposed within the housing 42 of the electronic key 40 (see FIG. 6). Battery 48 may be a conventional extended-life replaceable battery, or alternatively, a rechargeable battery suitable for use with the charging station. The logic control circuit 50 is operatively coupled and electrically connected to a switch 52 that is actuated by a control button 54 provided on the exterior of the key 40 and extending through the housing 42. Control button 54 in conjunction with switch 52 controls certain operations of the logic control circuit 50, and in particular, transmission of power between the key 40 and a merchandise security device. In one embodiment, actuation of the key 40 via the control button 54 results in the transfer of power for a predetermined duration (e.g., about 1-3 seconds) before power ceases being transferred.

In another embodiment, the logic control circuit 50 is further operatively coupled and electrically connected to a communication system, for example an optical transceiver 56 (see FIG. 6), for transferring the handshake communication protocol and SDC data. As a result, the transfer probe 44 of the key 40 may be provided with an optically transparent or translucent filter window 60 for emitting and collecting optical transmissions between the key 40 and a programming station, or between the key 40 and the merchandise security device, as required.

As previously mentioned, transfer probe 44 contains an inductive coil 46 comprising ferrite core 45 and inductive core windings 47 for transferring electrical power to the merchandise security device and/or receiving electrical power from the charging station to charge the internal battery 48, as required. Accordingly, the leads 47A and 47B of the inductive coil 46 are electrically connected to the logic control circuit 50, which in turn is electrically connected to the battery 48, in a suitable manner, for example by conductive insulated wires or plated conductors. Alternatively, the optical transceiver 56 may be eliminated and data transferred between the electronic key 40 and the merchandise security device via magnetic induction through the inductive coil 46.

Figure 7:
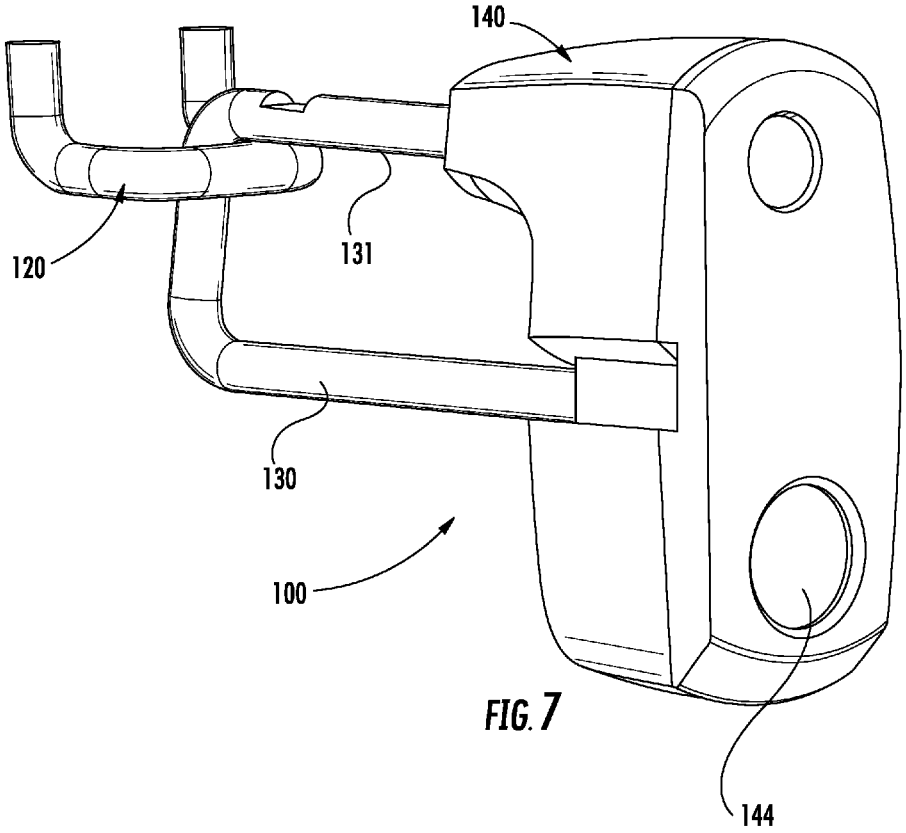
FIG. 7 is a front perspective view of a merchandise security device configured for use with an electronic key according to an exemplary embodiment of the invention.

FIG. 7 shows a merchandise security device 100 configured for use with an electronic key 40 (e.g., FIG. 4) according to an exemplary embodiment of the invention. More particularly, the security device 100 is a locking hook configured to be secured to a display surface, such as slat wall, grid, or pegboard. The locking hook 100 generally includes a base 120 configured to be secured to the display surface and an end assembly 140 or housing configured to cooperate with the electronic key 40 for locking or unlocking the end assembly. The locking hook 100 may also include at least one elongate lower rod 130 configured to be selectively secured to the end assembly 140 and to support items of merchandise thereon. The end assembly 140 of the locking hook 100 may be configured to be locked or unlocked to the lower rod 130 using inductive power transfer. More particularly, an inductive coil 146 may be configured to be energized inductively through a transfer port 144 provided on the end assembly 140 using the electronic key 40. In one embodiment, the transfer probe 44 of the key 40 and associated inductive coil 46 is configured to be positioned within the transfer port 144 such that the inductive coil 146 at least partially surrounds the inductive coil 46. Thus, the transfer port 144 may define a recess for receiving the transfer probe 44 of the key 40.

In one embodiment, the end assembly 140 includes an inductive coil 146 disposed within or proximate to the transfer port 144 on the end assembly 140 and a solenoid that is in electrical communication with the inductive coil. As previously described with reference to the inductive coil 46 of the electronic key 40, the inductive coil 146 comprises a plurality of inductive core windings 147 of an electrically conductive material. An alternating current may be transferred through the core windings 147. The alternating current in the core windings 147 may be provided to the solenoid by connecting leads of the windings to the solenoid. As a result, the inductive coil 146 is in electrical communication with the solenoid such that power transferred through the inductive coil is provided to the solenoid. The solenoid may be operable to disengage a lock mechanism 150 engaging the rod 130. For example, actuation of the solenoid may result in linear and/or rotary movement of a mechanical lock mechanism 150 that disengages the end assembly 140 from a notch, recess or the like formed in the lower rod 130.

In another embodiment shown in FIGS. 8A-8D, a shape memory material 154 may be employed in conjunction with inductive power transfer to operate the lock mechanism 150 of the locking hook 100. The shape memory material 154 may be in electrical communication with the inductive coil 146 and configured to change in shape in response to electrical current being transmitted through the shape memory material. A change in the shape of the shape memory material 154 may, in turn, result in actuation of the lock mechanism 150. As such, the locking device 100 may also not require a rectifier for converting the alternating current into direct current for operating the lock mechanism 150. In this regard, some merchandise security devices require that the alternating current induced in an inductive coil be transformed into a direct current, such as via a bridge rectifier or a logic control circuit, to provide direct current (DC) power to the security device. Such a conversion is not required by the present invention, as the alternating current may be used to actuate the lock mechanism. Indeed, the security device may also not require a battery, motor, solenoid, and/or any other electrical component as discussed above. Therefore, the lock mechanism is simplified for use with a variety of different security devices.

Figure 8A:
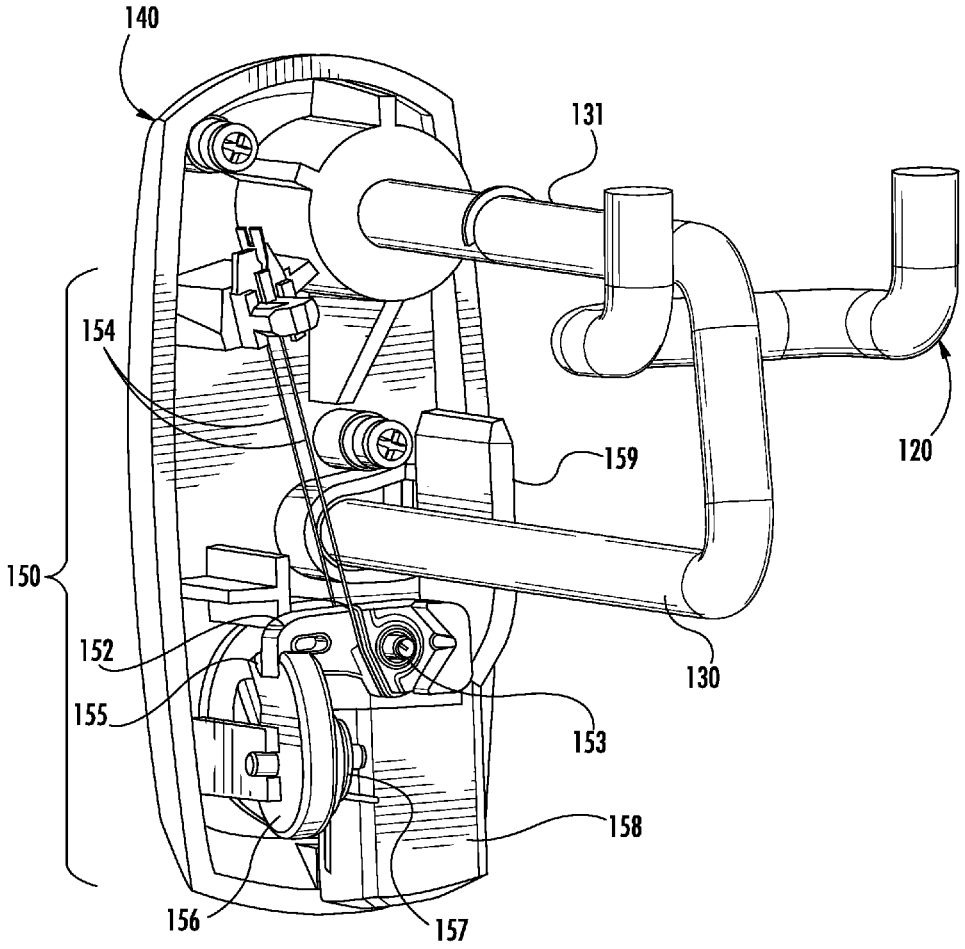
FIG. 8A is a rear partial perspective view showing the interior of the merchandise security device of FIG. 7 with a lock mechanism in a locked configuration.
Figure 8B:
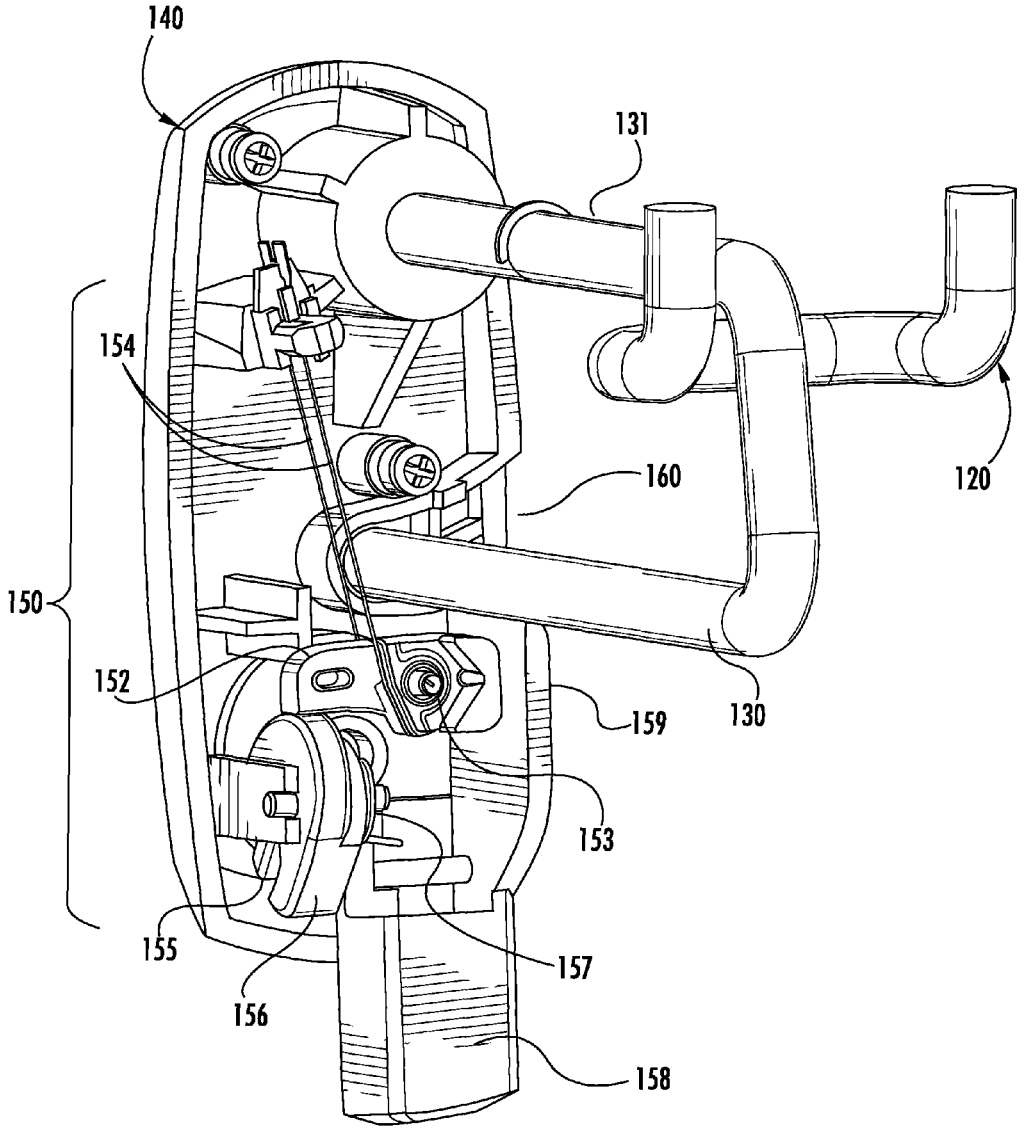
FIG. 8B is a rear partial perspective view showing the interior of the merchandise security device of FIG. 7 with the lock mechanism in an unlocked configuration.
Figure 8C:
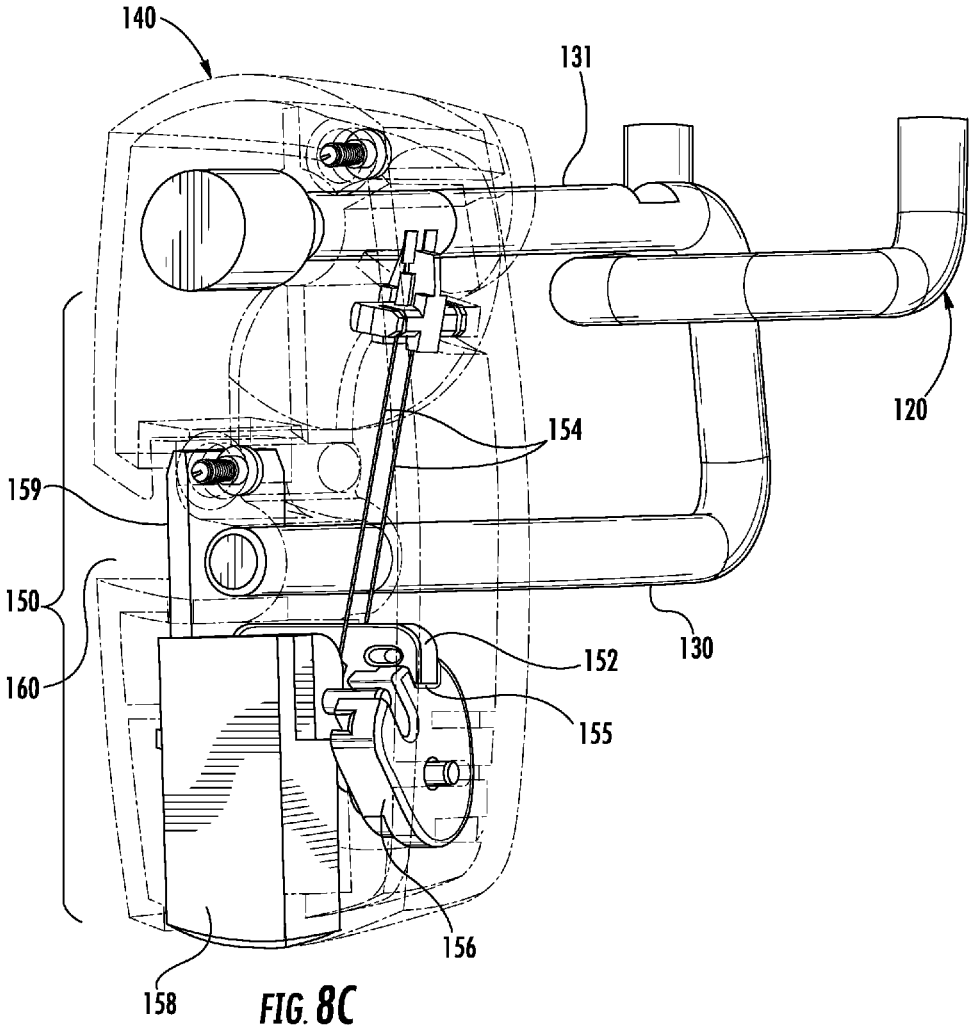
FIG. 8C is a front partial perspective view showing the interior of the merchandise security device of FIG. 7 with the lock mechanism in the locked configuration.
Figure 8D:
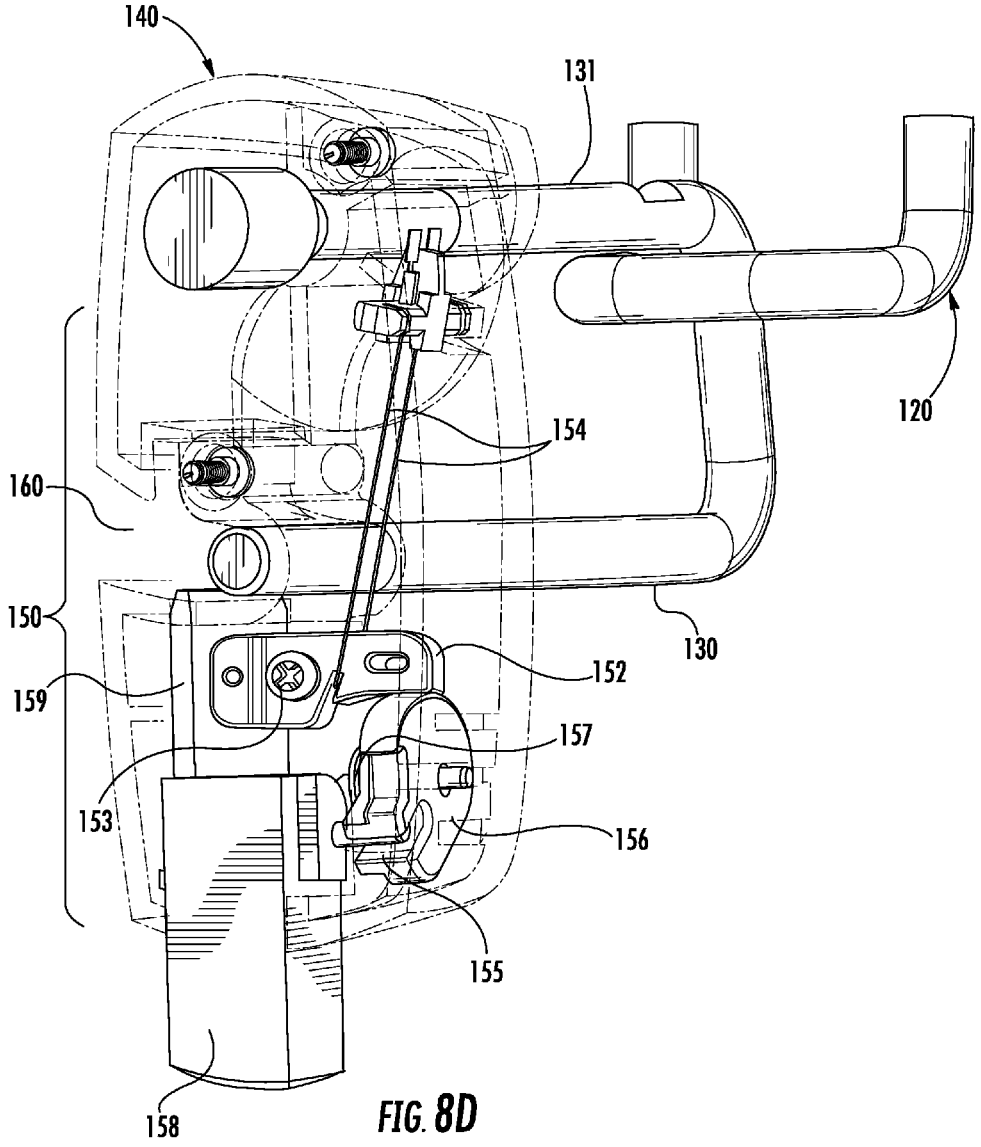
FIG. 8D is a front partial perspective view showing the interior of the merchandise security device of FIG. 7 with the lock mechanism in the unlocked configuration.

FIGS. 8A and 8B show the interior of the end assembly 140 of the locking device 100 from the rear with the lock mechanism 150 in the closed and opened positions, respectively. FIG. 8C and FIG. 8D show the interior of the end assembly 140 of the locking device 100 from the front with the lock mechanism 150 in the closed and opened positions, respectively. In each instance, a portion of the end assembly 140 is removed for purposes of clarity. The lock mechanism 150 comprises a retaining arm 152 that is pivotally mounted about a retaining arm pin 153 and connected to the shape memory material 154. Lock mechanism 150 further comprises an actuator 156 that is rotatably mounted on the end assembly 140 and configured for operable engagement with the retaining arm 152. As best shown in FIG. 8A and FIG.

8C, actuator 156 has a notch 155 configured for receiving an end of the retaining arm therein. Actuator 156 is further configured for operable engagement with a latch 158 that is moveable in a generally vertical direction relative to the locking device 100. More particularly, latch 158 is configured for vertical sliding movement within end assembly 140. Actuator 156 and latch 158 are engaged such that rotation of actuator 156 results in vertical movement of latch 158, and vertical movement of latch 158 causes rotational movement of actuator 156. Furthermore, actuator 156 is engaged by a torsional spring 157 such that latch 158 is biased in an extended position (FIG. 8B; FIG. 8D).

In this embodiment, the shape memory material 154 is Nitinol in the form of a wire. The shape memory material changes length, and in particular, contracts when an electrical current is transferred from the inductive coil 146 in response to actuation of the electronic key 40. Wire 154 is operably connected to the retaining arm 152 such that the retaining arm pivots upwardly about the retaining arm pin 153 when the shape memory material contracts. As a result, the end of the retaining arm 152 disengages from the notch 155 formed in actuator 156, and the actuator rotates under the biasing influence of the torsional spring 157 to move latch 158 from a retracted position (FIG. 8A; FIG. 8C) in a locked configuration to an extended position (FIG. 8B; FIG. 8D) in an unlocked configuration. Latch 158 comprises a finger 159 that covers an opening 160 formed in the end assembly 140 in the locked configuration and uncovers the opening 160 in the unlocked configuration. The opening 160 allows the end assembly 140 to be rotated about the upper rod 131 away from the lower rod 130 to permit items of merchandise to be loaded onto or removed from the lower rod in the unlocked configuration. Thereafter, the end assembly 140 may be rotated back onto the lower rod 130 and the locking device 100 returned to the locked configuration by moving latch 158 vertically upward against the biasing force of the torsional spring 157 until the actuator 156 engages the retaining arm 152. If desired, the end of the retaining arm 152 may engage the notch 155 formed in actuator 156 under the influence of gravity. Alternatively, retaining arm 152 may be biased to pivot about retaining arm pin 153 into engagement with notch 155 of actuator 156 by, for example, a torsional spring.

Figure 10:
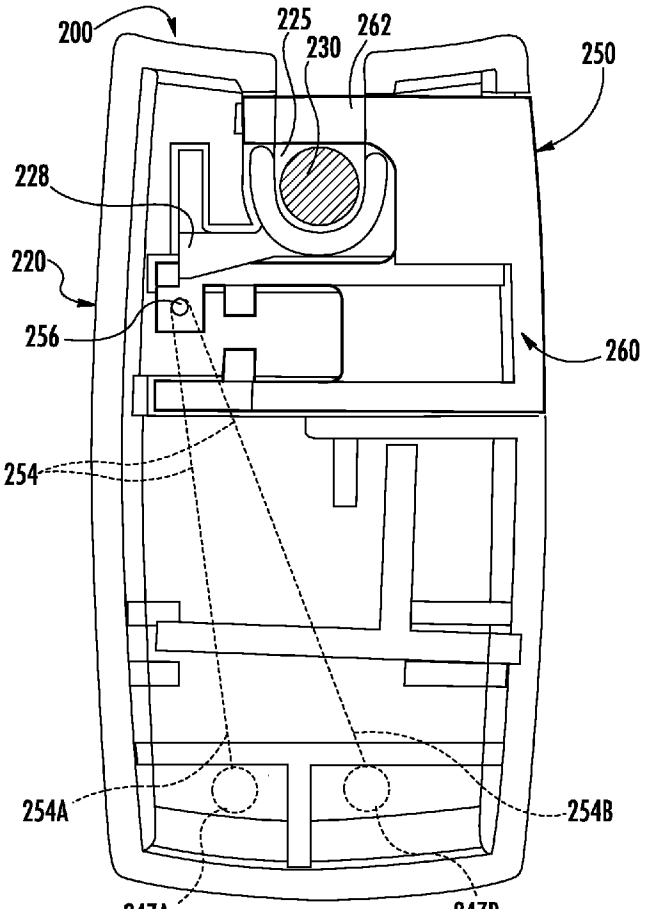
FIG. 10 is an elevation view of the merchandise security device of FIG. 9 with components of the lock mechanism removed for purposes of clarity showing the lock mechanism in the locked configuration.
Figure 12:
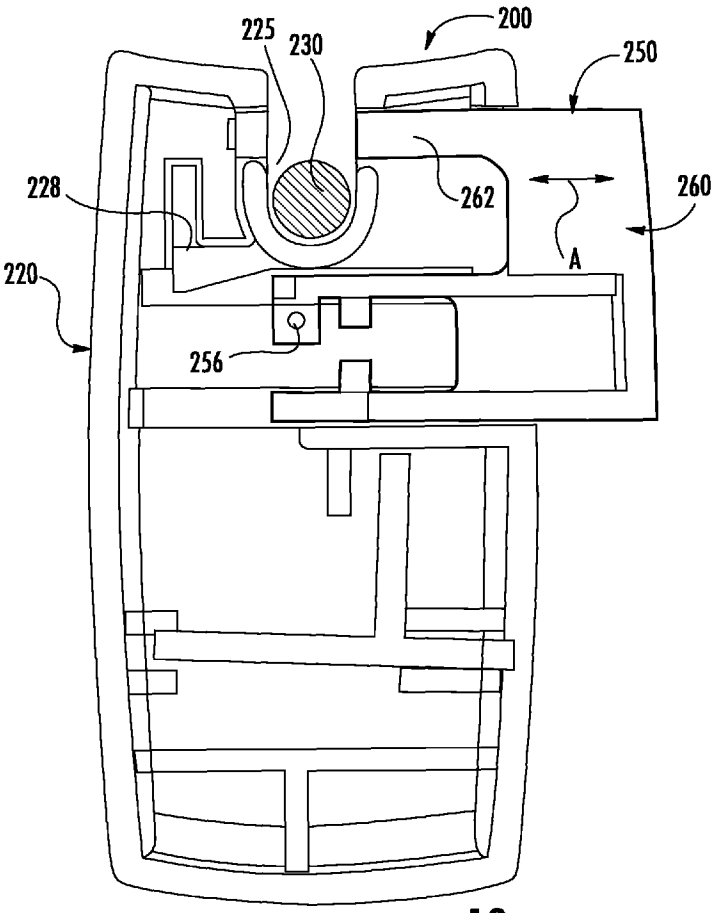
FIG. 12 is an elevation view of the merchandise security device of FIG. 9 with components of the lock mechanism removed for purposes of clarity showing the lock mechanism in the unlocked configuration.
Figure 11:
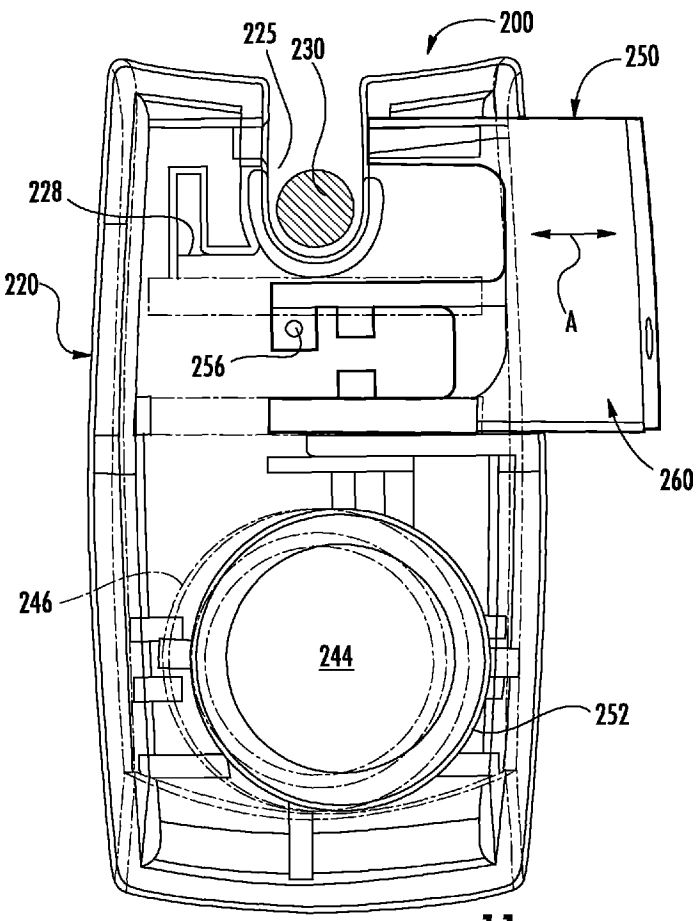
FIG. 11 is an elevation view of the merchandise security device of FIG. 9 showing the lock mechanism in an unlocked configuration.

FIGS. 9-13 show another merchandise security device 200 configured for use with an electronic key 40 (e.g., FIG. 4) according to an exemplary embodiment of the invention. Similar to the security device 100 discussed above, security device 200 is a locking device configured to be secured to at least one rod 230 of a merchandise display hook. In this regard, the locking device 200 is configured to be secured to a rod 230 of a merchandise display hook in a locked configuration (see FIG. 9; FIG. 10) and to be removed from the rod 230 in an unlocked configuration (see FIG. 11; FIG. 12). The locking device 200 includes a housing 220 and a lock mechanism 250. The lock mechanism 250 is configured to releasably engage the at least one rod 230. For example, the lock mechanism 250 may be configured to extend and retract relative to the housing 220 to define an opening 225 that is configured to receive the rod 230 therethrough. When the lock mechanism 250 is disengaged, the locking device 200 may be removed from the rod 230. However, when the lock mechanism 250 is engaged with the housing 220, the locking device 200 is unable to be removed from the rod 230.

In one example, the lock mechanism 250 includes a plunger mechanism 260 that is configured to extend and retract relative to the housing 220. The plunger mechanism 260 may include an arm member 262 that is operable for being retracted across the opening 225 when the locking device 200 is in a locked configuration, and to be extended to expose the opening 225 when the locking device 200 is in an unlocked configuration. The plunger mechanism 260 may be in sliding engagement with the housing 220 such that the plunger mechanism is configured to slide relative to the housing in a substantially linear direction A (see FIG. 11; FIG. 12) that is generally perpendicular to a longitudinal axis of the rod 230. The plunger mechanism 260 could include one or more sliding members 264 that are configured to engage with and slide relative to the housing 220. For example, the housing 220 may define one or more corresponding slots for receiving a sliding member 264 and to limit relative movement of the plunger mechanism 260 once in the unlocked configuration. In some embodiments, the plunger mechanism 260 is biased towards an unlocked configuration, such as with an elastic, linear spring. The plunger mechanism 260 may define an opening 266 (FIG. 13) for receiving such a spring or other biasing member. As a result, when the lock mechanism 250 is unlocked, the plunger mechanism 260 may be biased towards the unlocked configuration.

As before, the locking device 200 includes an inductive coil 246 disposed proximate to or within a transfer port 244 of the locking device 200. In this example, the inductive coil 246 may be wrapped about a bobbin 252 and coupled to a shape memory material 254. In this embodiment, the shape memory material 254 is Nitinol in the form of a wire. The inductive coil 246 is in electrical communication with the wire 254, and further, is configured to receive electrical power from electronic key 40 via transfer port 244, as previously described. In certain embodiments, one end 254A of the wire 254 is attached to one end 247A of the inductive coil 246, while an opposite end 254B of the wire 254 is attached to the opposite end 247B of the inductive coil 246. Alternatively, it is understood that one or more shape memory materials 254 may be employed to electrically couple the inductive coil 246 to the plunger mechanism 260. As shown in FIG. 10, the wire 254 may extend from the inductive coil 246, couple to the plunger mechanism 260, and extend back to the inductive coil. A portion of the shape memory wire 254 may be coupled to the plunger mechanism 260, such as by being wrapped about a pin 256. In this manner, transferring power to the locking device 200 by inducing electric current in the inductive coil 246 and transmitting the electric current through the shape memory wire 254 causes the wire to contract and the lock mechanism 250 to unlock the plunger mechanism 260.

The plunger mechanism 260 may include one or more engagement members 268 that are configured to engage one or more corresponding engagement members 228 of the housing 220 in a locked configuration. In one embodiment, at least a portion of the plunger mechanism 260 may be flexible such that contraction of the shape memory material 254 is configured to bias engagement member 268 out of engagement with engagement member 228. In one example, a portion of the plunger mechanism 260 may be cantilevered such that an end is configured to pivot relative to the housing 220. When the engagement members 268, 228 disengage, the plunger mechanism 260 is configured to slide relative to the housing 220 to the unlocked configuration (FIG. 11; FIG. 12).

Figure 9:
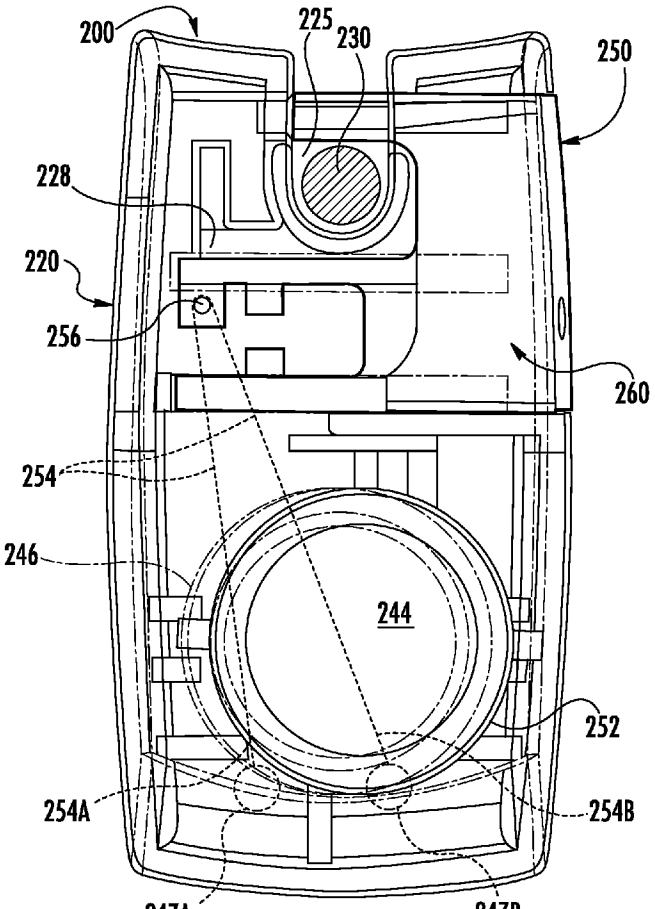
FIG. 9 is an elevation view of another merchandise security device configured for use with an electronic key according to an exemplary embodiment of the invention showing a lock mechanism in a locked configuration.
Figure 13:
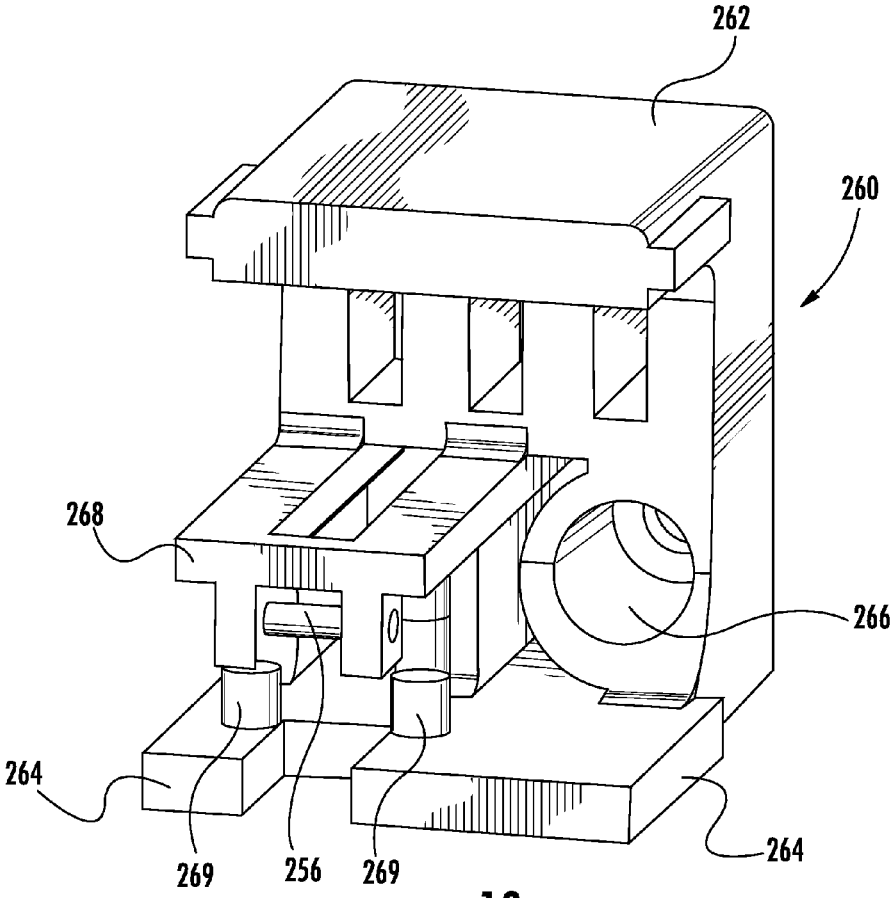
FIG. 13 is a perspective showing the plunger mechanism of the merchandise security device of FIG. 9 in greater detail.

In some embodiments, the plunger mechanism 260 may be biased towards the engagement member 228 such that when the plunger mechanism 260 is retracted within the housing 220, the engagement member 268 of the plunger mechanism is urged back into engagement with the engagement member 228 of the housing 220 in the locked configuration (FIG. 9; FIG. 10). For example, FIG. 13 shows that one or more alignment mechanisms 269 may be utilized to position one or more respective biasing members relative to the plunger mechanism 260 for biasing portions of the plunger mechanism relative to the housing 220. It is understood that various biasing members could be employed, such as one or more elastic, linear springs.

FIGS. 14-21 illustrate another merchandise security device 300 configured for use with an electronic key 40 (e.g., FIG. 4) according to an exemplary embodiment of the invention. In this embodiment, the security device 300 is a lockable enclosure commonly referred to in the art as a "safer." The security device 300 includes a housing 320 or container defining a generally hollow interior compartment 321 configured to receive an item of merchandise M therein. The security device 300 also includes a lid 340 engaged with the housing 320 that is configured to move between opened and closed positions relative to the housing. A lock mechanism 350 is operably engaged with the lid 340 and the housing 320 to lock the lid 340 onto the housing 320 in the closed position. As previously described, the security device 300 includes a shape memory material 354 that is operably engaged with the lock mechanism 350 and configured to change shape in response to the lock mechanism receiving electrical power from the electronic key 40. In particular, the shape memory material 354 is operable for unlocking the lid 340 from the housing 320 so that the item of merchandise may be removed from the housing in the opened position. The security device 300 may include a transfer port 344 on the lid 340 or the housing 320 that is operably engaged with the shape memory material 354. As discussed above, the transfer port 344 is configured to receive electrical power, for example from the electronic key 40, and to transfer the electrical power via an electrical conductor (e.g., a coil) to the shape memory material 354.

Figure 14:
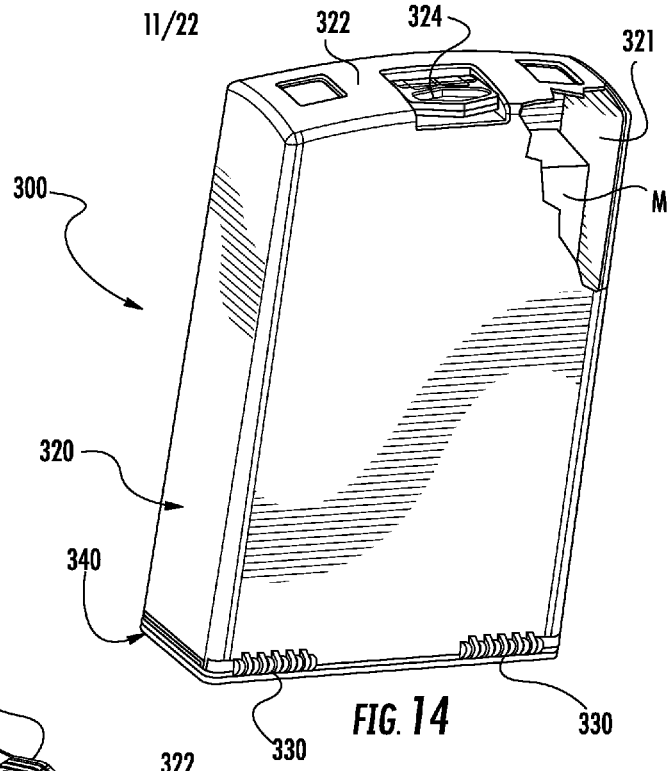
FIG. 14 is a rear perspective view of another merchandise security device configured for use with an electronic key according to an exemplary embodiment of the invention.
Figure 15:
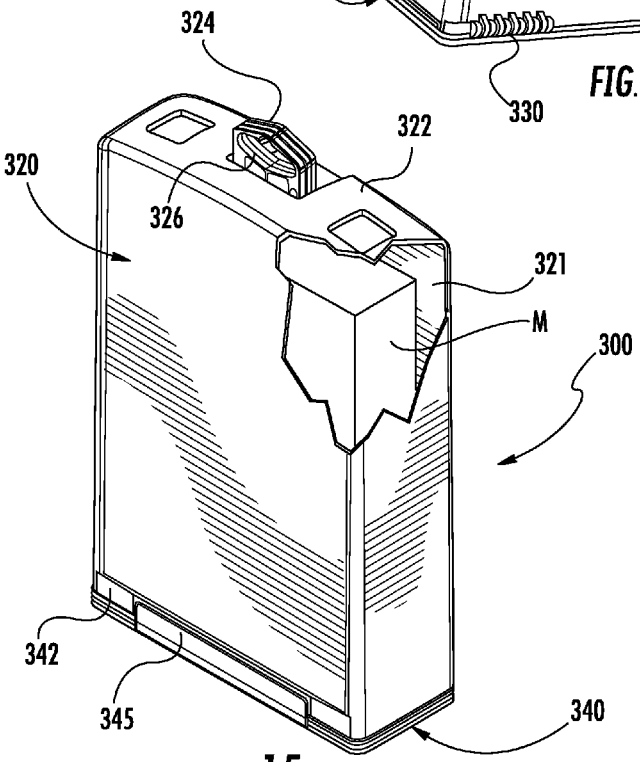
FIG. 15 is a front perspective view of the merchandise security device of FIG. 14.
Figure 16:
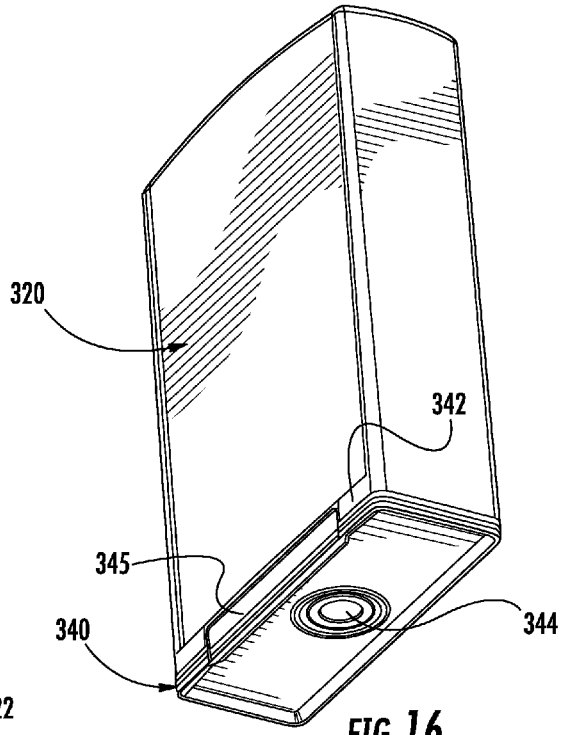
FIG. 16 is a top perspective view of the merchandise security device of FIG. 14 showing a lock mechanism in a locked configuration.

In one embodiment, the housing 320 also includes a removable hang tag 324 operably engaged with the housing. The hang tag 324 may be defined on an upper surface 322 of the housing 320 opposite the lid 340. The hang tag 324 may include an opening 326 configured to receive a rod therethrough for hanging one or more of the security devices 300 on the rod in a display orientation. The hang tag 324 may be configured to pivot between an upright position (FIG. 15; FIG. 16) and a folded position (FIG. 14). In some embodiments, the hang tag 324 is configured to be inserted upwardly through an opening defined in the housing 320. For example, the hang tag 324 may be inserted from the inside of the housing 320 such that the hang tag may not be removed from the housing from outside of the housing. Furthermore, the hang tag 324 may be configured to snap into place within the housing 320 so as to be removable. Alternatively, the hang tag 324 maybe secured so as to be fixed relative to the housing with other techniques, such as a fastener or adhesive. It is understood that the hang tag 324 may take many other configurations, such as, for example a flexible member or strap that is engaged with the housing 320. In addition, in another embodiment the hang tag 324 may be rotatable relative to the housing 320. Thus, the hang tag 324 may allow the housing 320 to rotate about a generally vertical axis, such as when the housing is supported on a hook or rod, so as to allow a consumer to rotate the housing for further inspection of the item of merchandise contained therein.

As shown herein, the lid 340 is pivotally attached to the housing 320 (FIG. 14). Thus, the lid 340 pivots between opened and closed positions relative to the housing 320. The lid 340 may be pivotally connected to the housing 320 such that the outer surface of the lid 340 and housing 320 are substantially flush with the pivot connection 330. Thus, unlike conventional safers, the pivot connection 330 may be at least partially recessed within the housing 320. The pivot connection 330 may be any suitable connection, such as a barrel hinge on the housing 320 and/or the lid 340, and the housing 320 or the lid 340 may include a pin for engaging the barrel hinge. In the instance where the pivot connection 330 is not flush with the outer surface of the housing 320, it extends only negligibly (e.g., less than about 2 mm). As such, the flush or nearly flush pivot connection 330 facilitates stacking of multiple safers as well as more compact placement of adjacent safers.

Figure 17:
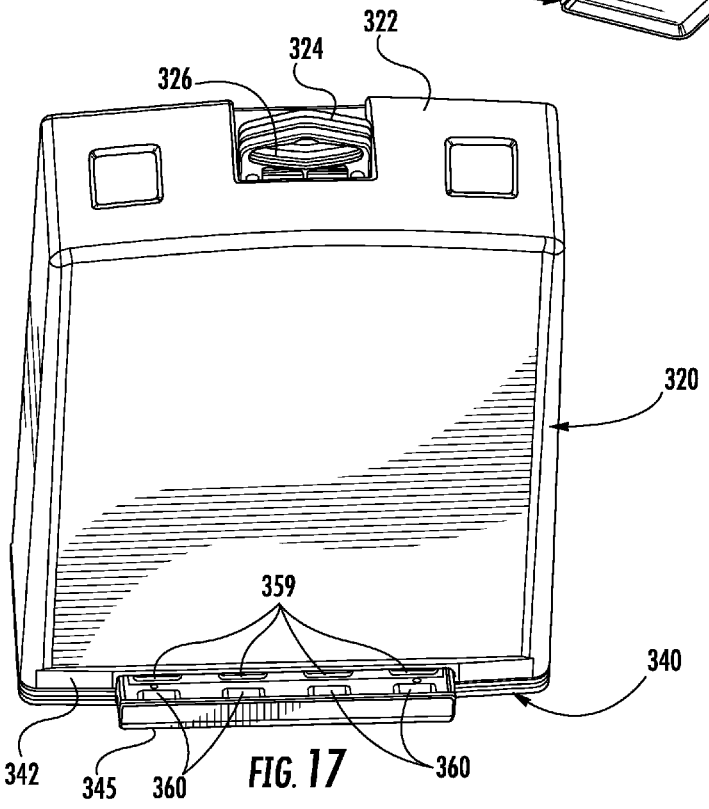
FIG. 17 is a bottom perspective view of the merchandise security device of FIG. 14 showing the lock mechanism in an unlocked configuration.
Figure 18:
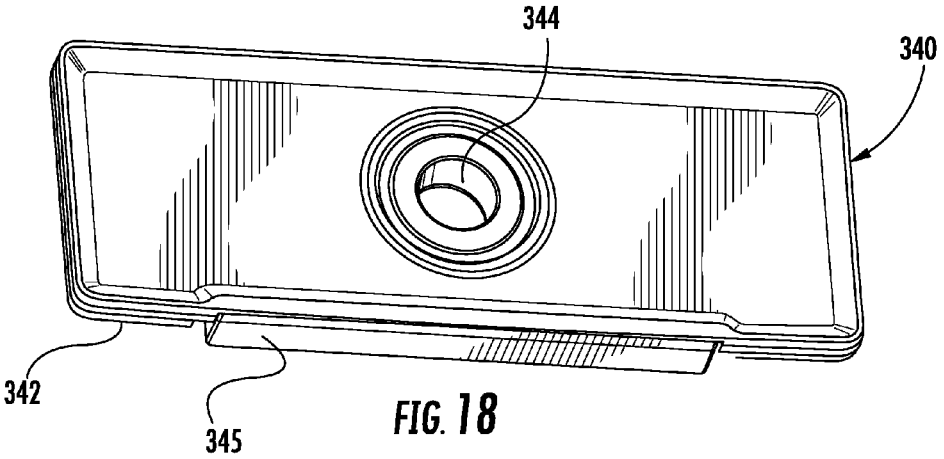
FIG. 18 is a bottom perspective view of a lid of the merchandise security device of FIG. 14 showing the lock mechanism in the locked configuration.
Figure 19:
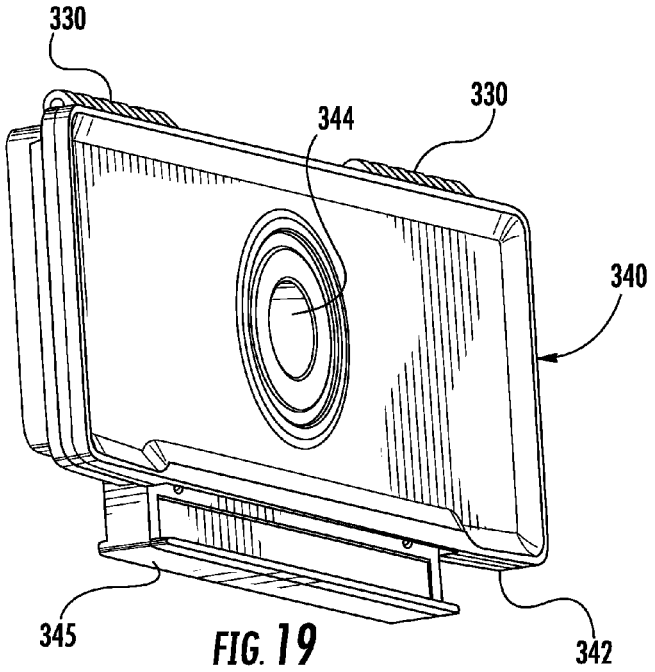
FIG. 19 is a bottom perspective view of the lid of the merchandise security device of FIG. 14 showing the lock mechanism in the unlocked configuration.
Figure 21:
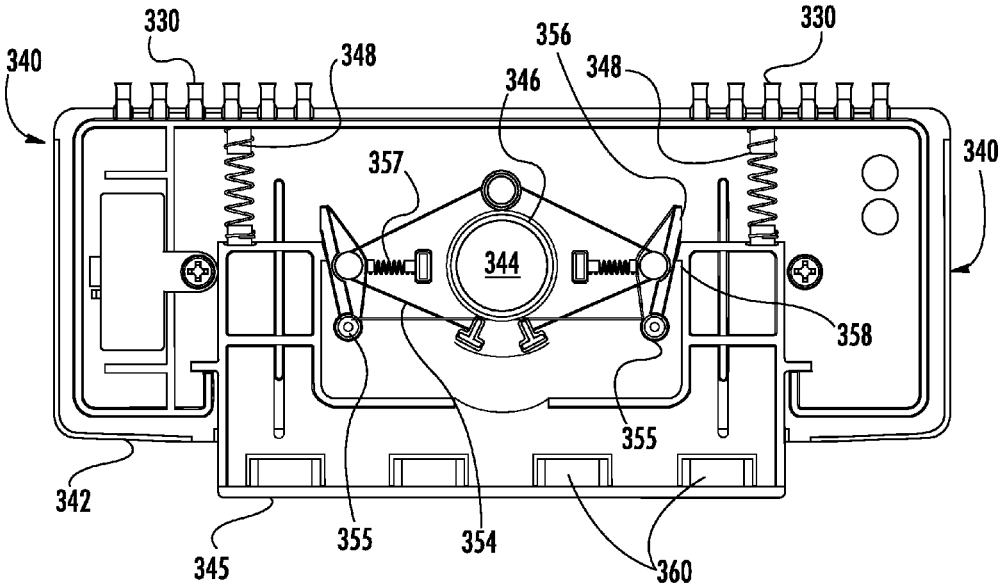
FIG. 21 is a plan view of the lid of FIG. 18 with the cover removed for purposes of clarity showing the lock mechanism in the unlocked configuration.

In this embodiment, the lid 340 of the security device 300 includes a movable latch 345. As illustrated in FIG. 16 and FIG. 17, the movable latch 345 is configured to move relative to the lid 340 between a retracted (locked) configuration (FIG. 16) and an extended (unlocked) configuration (FIG. 17). FIGS. 18 and 19 show that the latch 345 is moveable between a retracted configuration that is substantially flush with the lid 340 (FIG. 18), and an extended configuration relative to the lid 320 (FIG. 19). In the retracted configuration, the lid 340 is closed and locked to the housing 320 in the closed position. In the extended configuration, the lid 340 is unlocked from the housing 320 and may be moved (e.g. pivoted) to the opened position. The latch 345 may be biased, for example with one or more elastic, linear springs 348, such that unlatching the latch from the lid 340 allows the latch to move outwardly of the lid, and in some cases, automatically outward due to the biasing force pushing the latch outwardly of the lid. For example, FIG. 21 shows a pair of springs 348 may be configured to bias the latch 345 outwardly from the lid 340. In addition, the latch 345 may be configured to move outwardly of a front edge 342 of the lid 340. However, the latch 345 could be located at other positions on the lid 340 as desired. Moreover, the latch 345 may not latch automatically when the lid 340 is closed on the housing 320. Thus, the lock mechanism 350 may only lock when the lid 340 is in the closed position on the housing 320 and the latch 345 is pushed inwardly within the lid 340.

Figure 20:
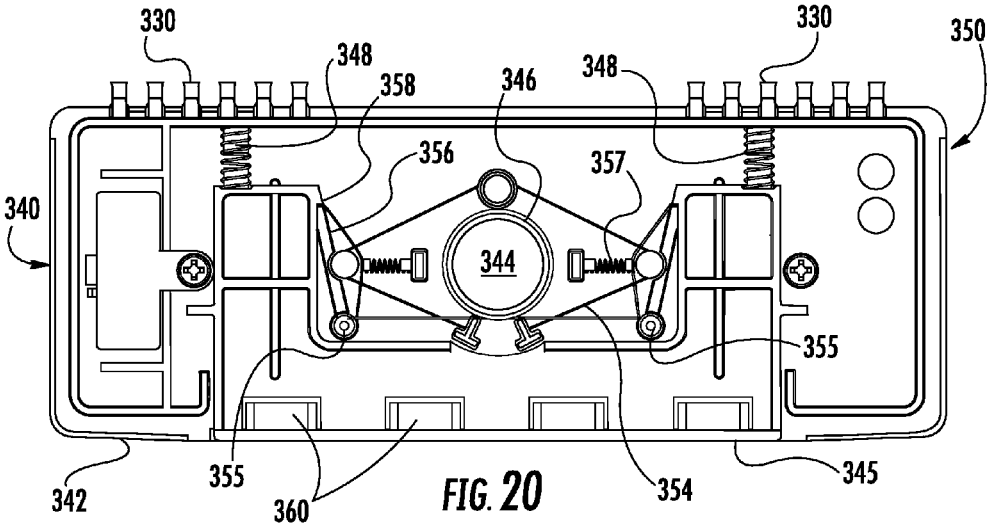
FIG. 20 is a plan view of the lid of FIG. 18 with the cover removed for purposes of clarity showing the lock mechanism in the locked configuration.

In some embodiments, the lock mechanism 350 comprises a plurality of engagement features 360 (e.g., pins, protrusions, or the like) and the housing 320 comprises a plurality of retaining features 359 (e.g., holes, openings, slots, or the like) (see, e.g., FIG. 17), and each of the engagement features are configured to engage a respective retaining feature with the lid 340 in the closed position and the latch 345 in the retracted (locked) configuration. Thus, when the engagement features 360 are engaged with the retaining features 359, the lid 340 cannot be removed from the housing 320 without first unlocking the lock mechanism 350. The engagement features 360 and retaining features 359 may be arranged in any suitable manner and include any desired number. In the illustrated embodiment, the retaining features 359 extend along a linear axis and are disposed on a front surface of the housing 320 proximate a lower edge. Similarly, the engagement features 360 may extend along a linear axis on the latch 345 adjacent the front edge 342 of the lid 340. FIGS. 20-21 show that the engagement features 360 may be engaged with the retaining features 359 via the movable latch 345. Where the latch 345 extends within a plane, the engagement features 360 are configured to move parallel to one another and within a generally parallel plane. Moreover, FIGS. 17, 20, and 21-22 show that the engagement features 360 and the retaining features 359 have a generally rectangular cross section. However, the engagement features 360 and corresponding retaining features 359 may have any desired shape (e.g., circular in cross section). As such, it is understood that the engagement features 360 may have a variety of sizes and configurations suitable for engaging correspondingly shaped retaining features 359 defined in the housing 320.

FIGS. 20 and 21 show the lock mechanism 350 in more detail, wherein a portion of the lid 340 has been removed for purposes of clarity. FIG. 20 shows the lock mechanism 350 in a locked configuration, while FIG. 21 shows the lock mechanism 350 in an unlocked configuration. In this embodiment, the lock mechanism 350 comprises a shape memory material 354 in the form of a Nitinol wire, as previously described. The shape memory wire 354 is attached to at least one, and as shown herein, a pair of moveable retaining arms 356 that are configured to engage corresponding retaining features 358 provided on the latch 345. The retaining features 358 may be any structure suitable for retaining the latch 345 in the retracted, or closed, position against the biasing force exerted on the latch by the springs 348. An inductive coil 346 disposed within or proximate to the transfer port 344 receives and transfers an electric current in the manner previously described. The inductive coil 346 is in electrical communication with and transmits the electrical current through the shape memory wire 354 resulting in contraction of the wire.

As the shape memory wire 354 contracts, the retaining arms 356 move, and in particular, pivot inwardly about retaining pins 355 to release the retaining arms from the retaining features 358 such that the latch 345 moves outwardly to the extended (unlocked) configuration. As shown, the retaining arms 356 may be biased, for example by one or more elastic, linear springs 357 to pivot outwardly about the retaining pins 355. In this manner, the retaining arms 356 will return into engagement with the retaining features 358 as the latch 345 is moved inwardly against the biasing force of the springs 348 to the retracted (locked) configuration. With the latch 345 in the extended (unlocked) configuration, one or more engagement features 360 provided on the latch are disengaged from corresponding retaining features 359 provided on the housing 320 such that lid 340 can be moved, and in particular, rotated about pivot connection 330 from a closed position to an opened position to access the interior compartment 321 of the housing 320. It should be noted that the lid 340 may be opened manually, or the lid could be biased towards an open position such that when the engagement features 360 on the lid disengage from the retaining features 359 on the housing 320, the lid is configured to at least partially open. In addition, the latch 345 may be manually retracted relative to the housing 320 to return the lock mechanism 350 to a locked configuration. Alternatively, the lock mechanism 350 could be configured to automatically lock when the lid 340 is returned to a closed position on the housing 320.

Figure 22:
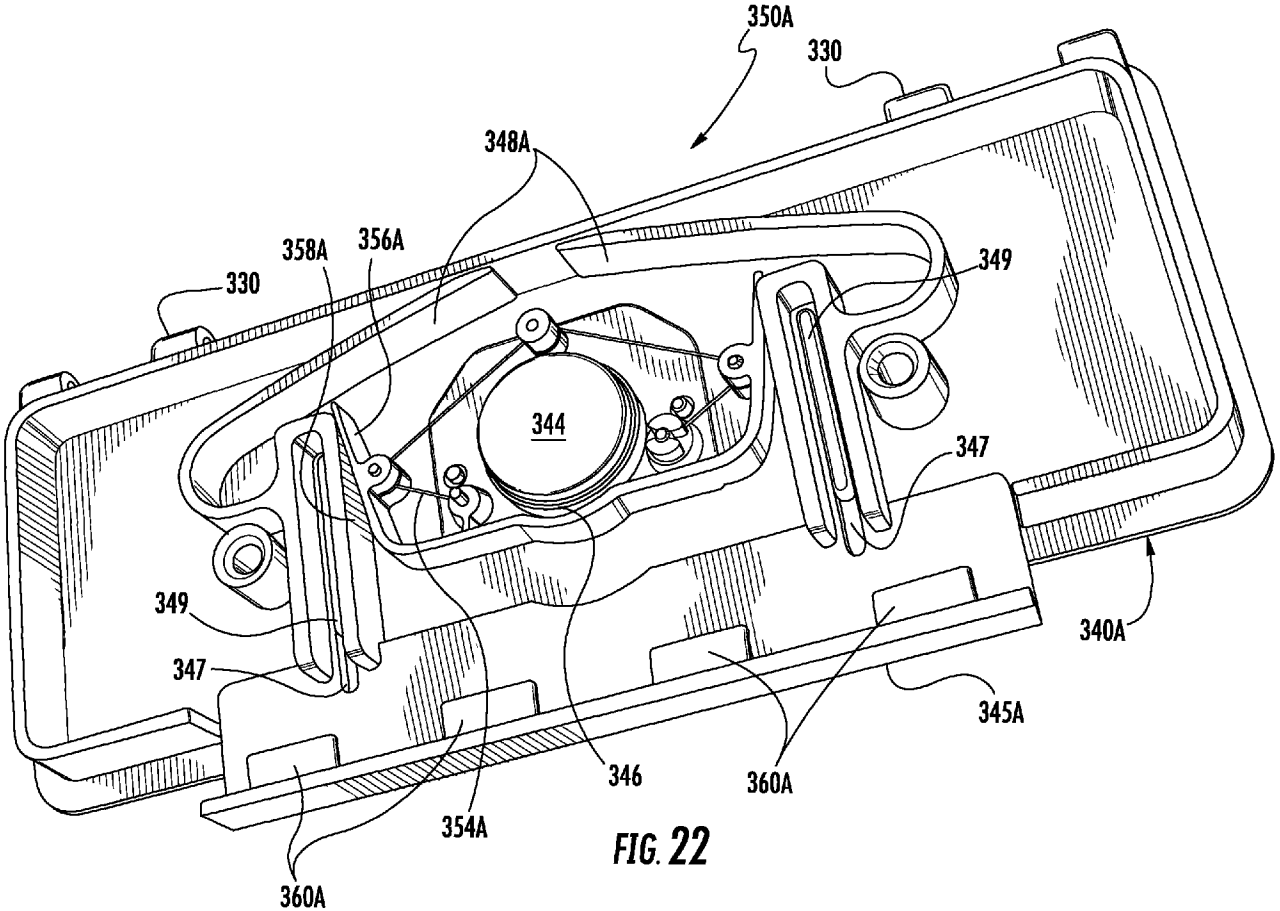
FIG. 22 is a perspective view showing a lid and movable latch of the merchandise security device of FIG. 14 according to an exemplary embodiment of the invention.
Figure 23:
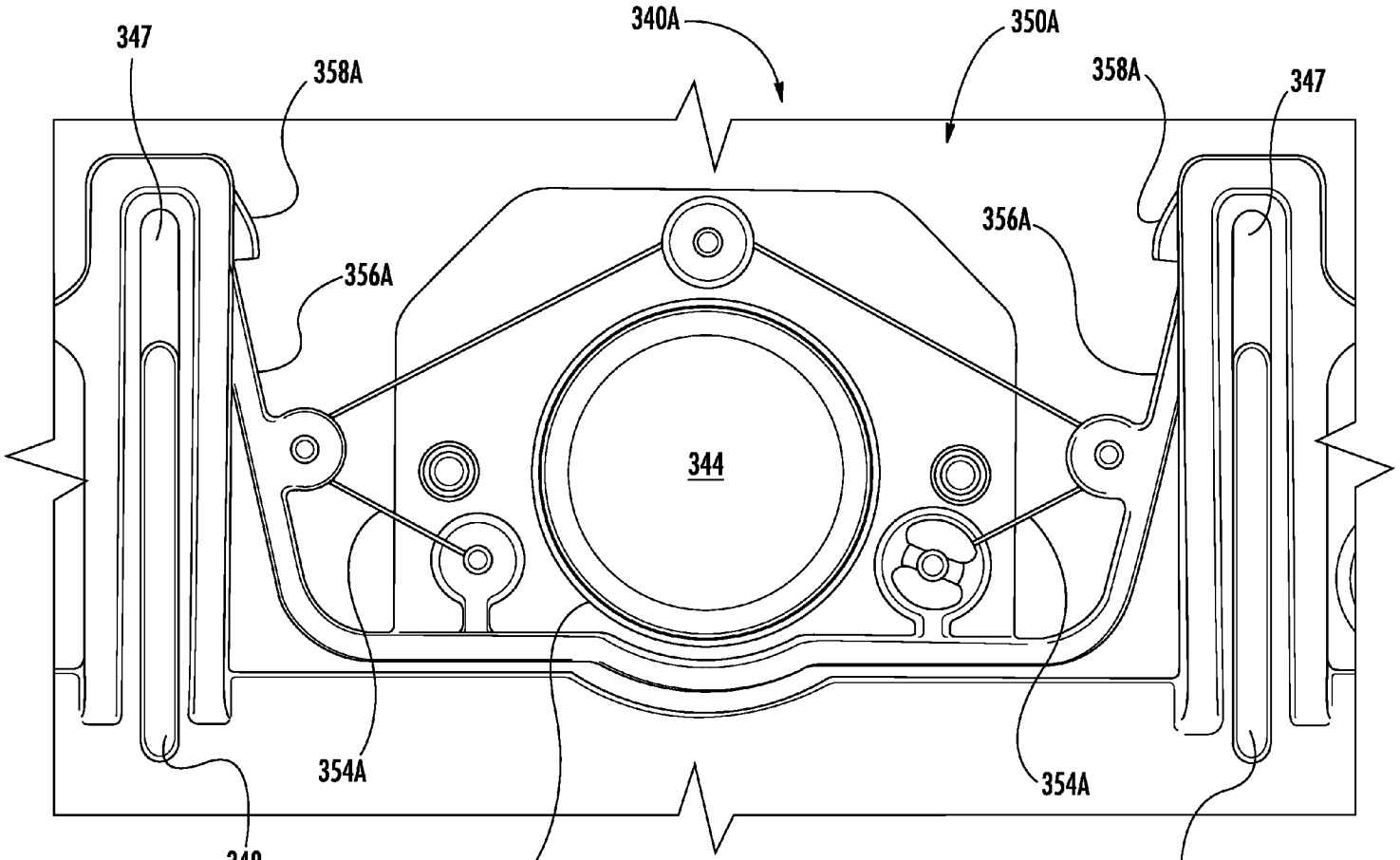
FIG. 23 is detail view of the lid and latch of FIG. 22 showing the lock mechanism in greater detail.

FIGS. 22 and 23 show another embodiment of a movable latch 345A disposed within a lid 340A that is pivotally mounted on a housing 320 by a pivot connection 330, as previously described, and a lock mechanism 350A according to another exemplary embodiment of the invention. FIG. 22 illustrates the latch 345A and lock mechanism 350A wherein the bottom surface of the lid 340A has been removed for purposes of clarity. FIG. 23 shows the lock mechanism 350A in greater detail. The latch 345A is movable between a retracted (locked) configuration wherein the latch is closed on the lid 340A and an extended (unlocked) configuration wherein the latch is open and the lid may be pivoted about the pivot connection 330 relative to the housing 320 to access the interior compartment 321 of the housing. The latch 345A includes a pair of biasing members 348A configured to bias the latch 345A outwardly relative to the lid 340A. Thus, the biasing members 348A may function as leaf springs, hinged springs, or the like that may be attached to or integrally molded with the lid 340A and/or latch 345A. In this example, the biasing members 348A are integrally formed with the latch 345A. When the latch 345A is pushed inside the lid 340A towards the locked configuration, the biasing members 348A are configured to be loaded (e.g., via folding of the biasing member on itself) such that unlocking the lock mechanism 350A allows the biasing members to move the latch outwardly of the lid (e.g., via unfolding of the biasing members). Thus, it is understood that a variety of techniques may be used to restrain movement of the latch 345A, maintain the lock mechanism 350A in a locked configuration, and to release the latch. The lock mechanism 350A includes a pair of flexible blocking members 356A that are configured to be biased between engaged and disengaged positions with respect to the movable latch 345A. In particular, the latch 345A may include a pair of engagement members 358A that are configured to engage the blocking members 356A in the locked configuration (see FIG. 23). In addition, latch 345A includes a shape memory material 354A in the form of a Nitinol wire, as previously described.

Figure 4:
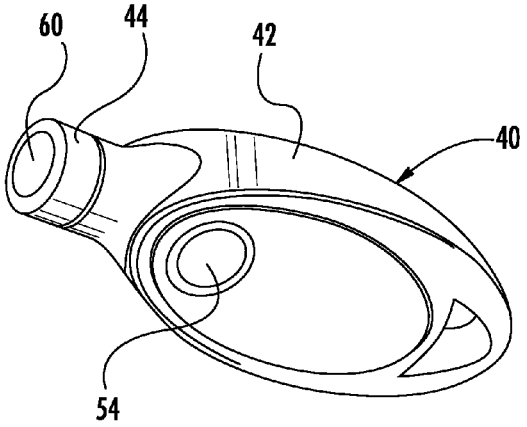
FIG. 4 is a left side perspective view of the electronic key of FIG. 1.
Figure 5:
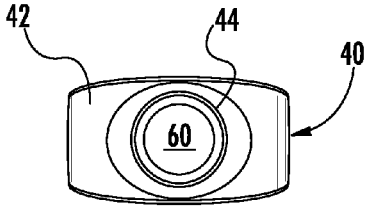
FIG. 5 is an end view of the electronic key of FIG. 1.

In this embodiment, the shape memory wire 354A is operably engaged in electrical communication with the inductive coil 346 disposed proximate to or within the transfer port 344 for receiving electrical power from the electronic key 40 (e.g., FIG. 4). The shape memory material 354A is shown as being a continuous wire that is attached to each of the flexible blocking members 356A, as well as the lid 340A at a plurality of locations. It is understood that the shape memory wire 354A may be secured to the lid 340A and blocking members 356A using any desired technique to effectuate disengagement of the latch 345A. Actuation of the shape memory material 354A, for example by transmitting an electric current through the wire, causes the material to contract, which in turn retracts the blocking members 356A from engagement with the engagement members 358A, thereby allowing the biasing members 348A to bias the latch 345A outwardly relative to the lid 340A to the extended (unlocked) configuration (FIG. 22). FIG. 22 further shows that the latch 345A may, if desired, include one or more slots 347 that are configured to receive respective alignment members 349 defined on the inner surface of the lid 340A for facilitating alignment and sliding between the latch and the lid. Movement of the latch 345A to the extended (unlocked) configuration disengages the engagement feature(s) 360 provided on the latch from the retaining feature(s) 359 provided on the housing 320 such that the lid 340A can be pivoted about the pivot connection 330 to access the interior compartment 321 of the housing.

In one embodiment, the latch 345, 345A and/or lock mechanism 350, 350A may be configured to be manufactured and assembled independently of the remaining components of the security device 300. Thus, the latch 345, 345A and/or lock mechanism 350 may be configured to be secured to any particular lid 340, 340A and may be readily replaceable if needed. The lid 340, 340A may include one or more alignment members 349 or other similar function features for aligning the latch 345, 345A and/or lock mechanism 350 on the lid. The latch 345, 345A and/or lock mechanism 350 may be secured to the lid 340, 340A using any desired technique, such as adhesives, welding, and/or fasteners.

FIGS. 24-34 show another merchandise security device 400 configured for use with an electronic key 40 (e.g. FIG. 4) according to an exemplary embodiment of the invention. Unlike the previously described merchandise security device 300, the security device 400 may have a "clam-shell" configuration for containing smaller items of merchandise, such as compact discs (CDs) or digital versatile discs (DVDs). For example, FIGS. 24-27 show a security device 400 including a housing 420 and a lid 440 pivotally coupled to the housing by a pivot connection 430, such as a barrel hinge. It is to be understood that although the terms "lid" and "housing" are used, such terminology should not be considered limiting, as the lid or housing may be used interchangeably given that the security device is shown in a clam-shell configuration, and the item of merchandise may be placed within the lid and/or the housing.

Figure 24:
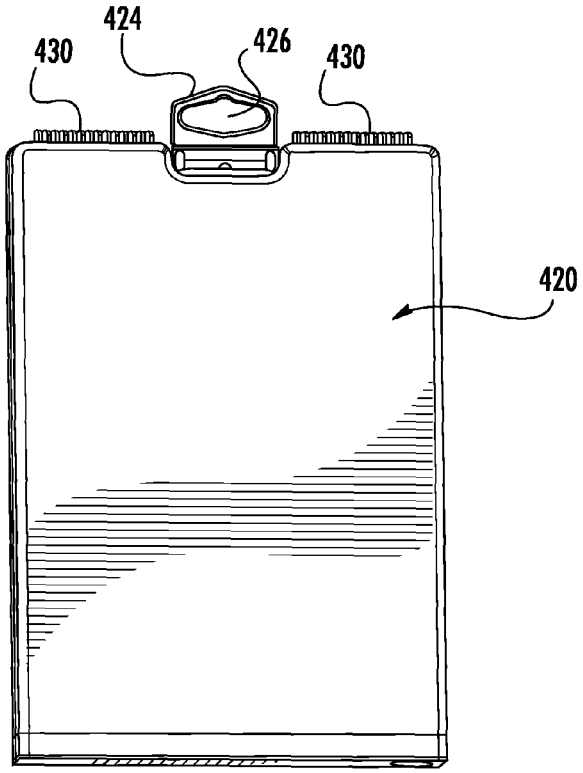
FIG. 24 is an elevation view of another merchandise security device configured for use with an electronic key according to an exemplary embodiment of the invention.
Figure 25:
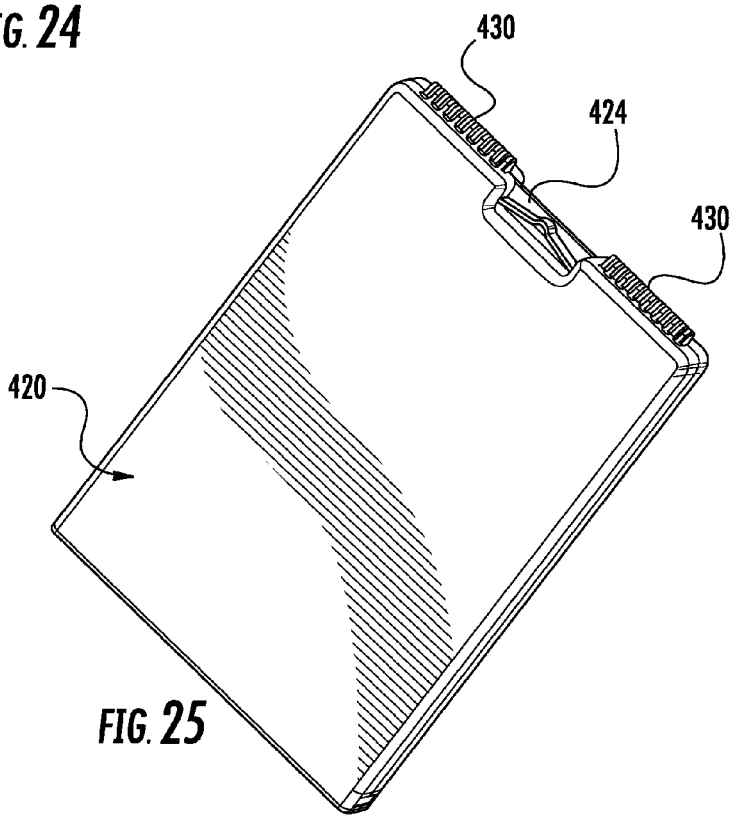
FIG. 25 is a front perspective view of the merchandise security device of FIG. 24.

The housing 420 or the lid 440 may include a hang tag 424 that may be used in the manner described above. The hang tag 424 may be configured to pivot relative to the housing 420 or the lid 440 between active (upright) and inactive (folded) positions. The hang tag 424 may be configured to pivot about the same axis as the pivot connection 430 between the housing 420 and the lid 440. FIG. 24 shows the hang tag 424 in an active position whereby the hang tag may have an opening 426 configured to receive a rod or the like. In the inactive position shown in FIG. 25, the hang tag 424 may be configured to pivot so as to be substantially flush with the outer surface 422 of the housing 420 and/or the outer surface 442 of the lid 440. The hang tag 424 may be L-shaped or a similar shape to facilitate pivoting between the active and the inactive positions, as well as conform to the outer surface contour of the housing 420 in an inactive position.

As in previous embodiments, a lock mechanism 450 may be operably engaged with a latch 445 provided on the lid 440, while the housing 420 may include one or more retaining features 459 configured to removably engage corresponding engagement features 460 provided on the lid. In this example, each of the retaining features 459 is configured to receive and engage a corresponding engagement feature 460 with the lid 440 in a closed position on the housing 420 and the latch 445 in a retracted (locked) configuration. As previously mentioned, in some embodiments the lock mechanism 450 provided on latch 445 of lid 440 comprises a plurality of engagement features 460 (e.g., pins, protrusions, or the like) and the housing 420 comprises a plurality of retaining features 459 (e.g., holes, openings, slots, or the like) (see, e.g., FIG. 27). Each of the engagement features 460 are configured to engage a respective retaining feature 459 with the lid 440 in the closed position and the latch 445 in the retracted (locked) configuration (see, e.g., FIG. 29). Thus, when the engagement features 460 are engaged with the retaining features 459, the lid 440 cannot be removed from the housing 420 without first unlocking the lock mechanism 450.

Figure 28:
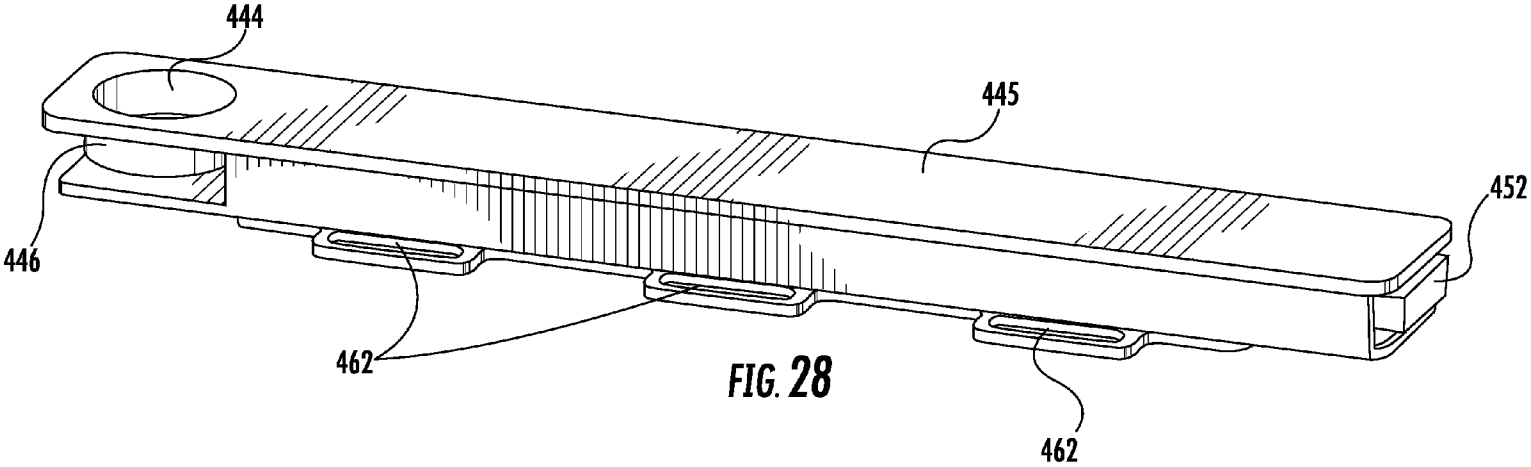
FIG. 28 is a bottom perspective view of a lock mechanism of the merchandise security device of FIG. 24 shown in a locked configuration.
Figure 29:
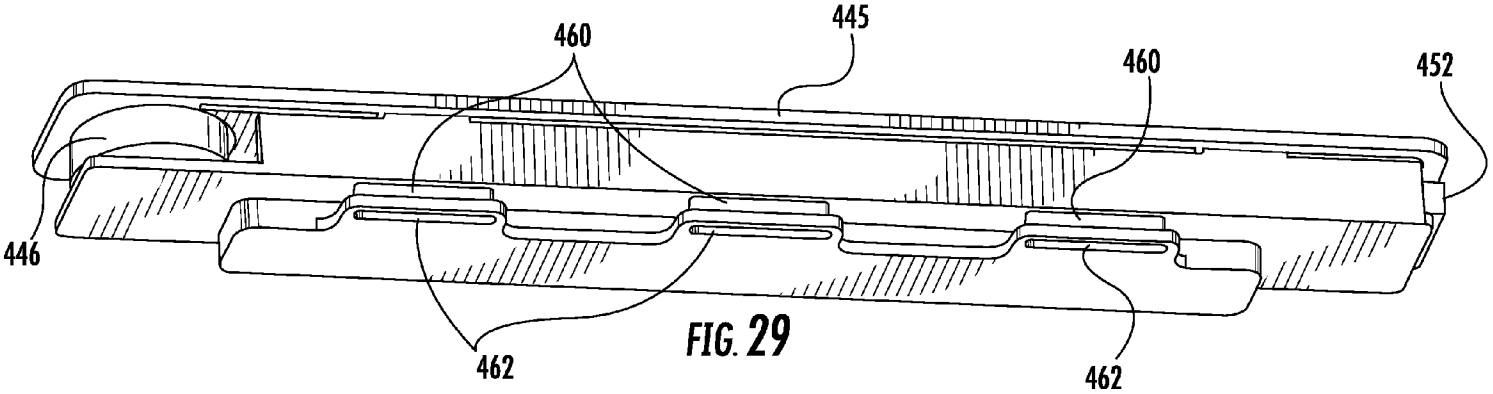
FIG. 29 is another bottom perspective view of the lock mechanism of FIG. 28 shown in the locked configuration.
Figure 30:
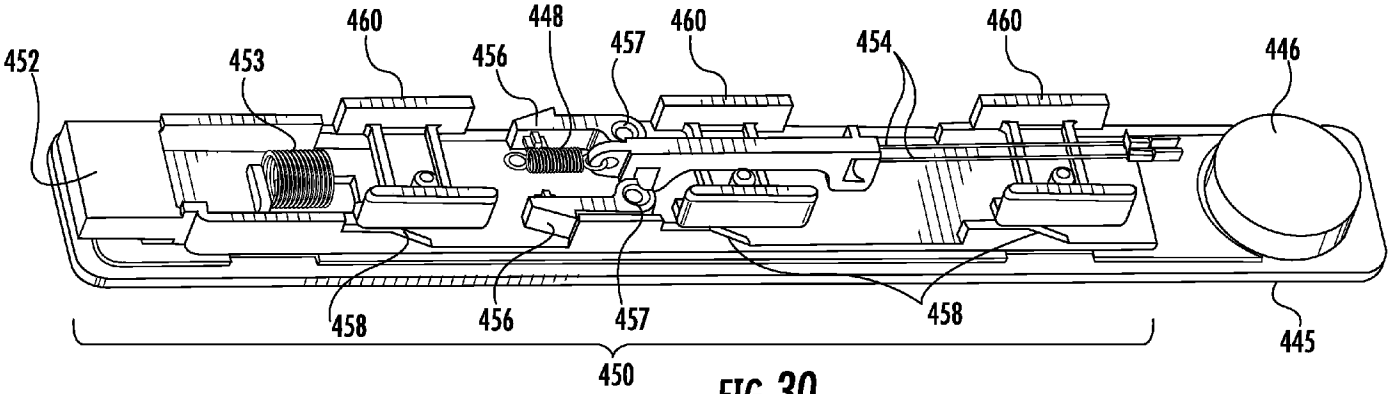
FIG. 30 is a top perspective view of the lock mechanism of FIG. 28 with the cover removed for purposes of clarity shown in the locked configuration.
Figure 31:
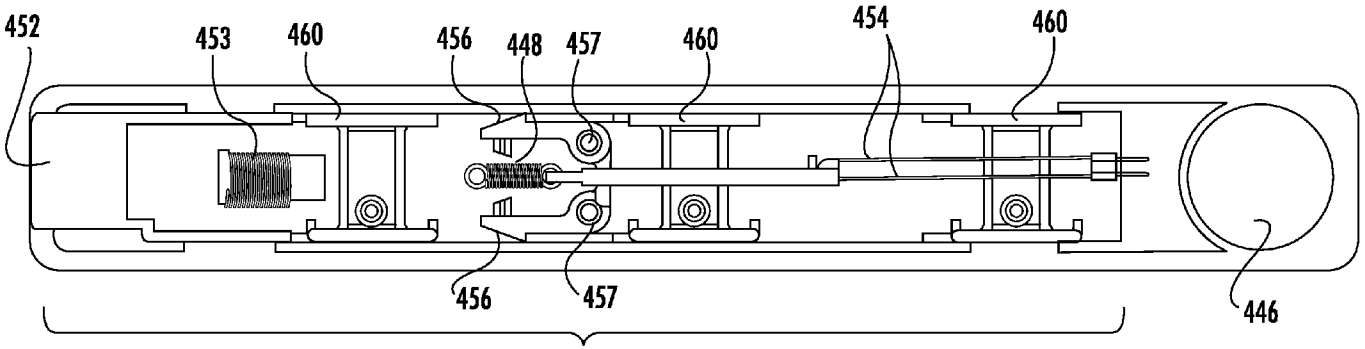
FIG. 31 is a top plan view of the lock mechanism of FIG. 28 with the cover removed for purposes of clarity shown in the locked configuration.
Figure 32:
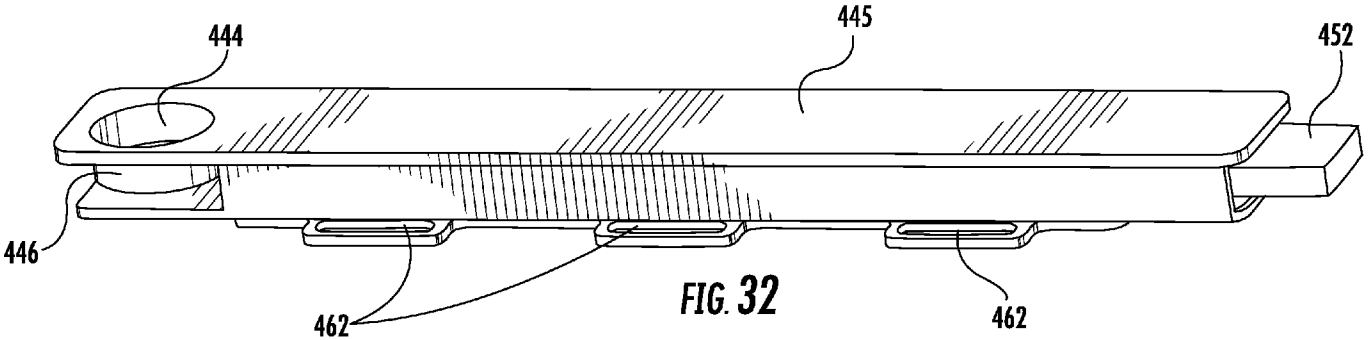
FIG. 32 is a bottom perspective view of the lock mechanism of FIG. 28 shown in an unlocked configuration.
Figure 33:
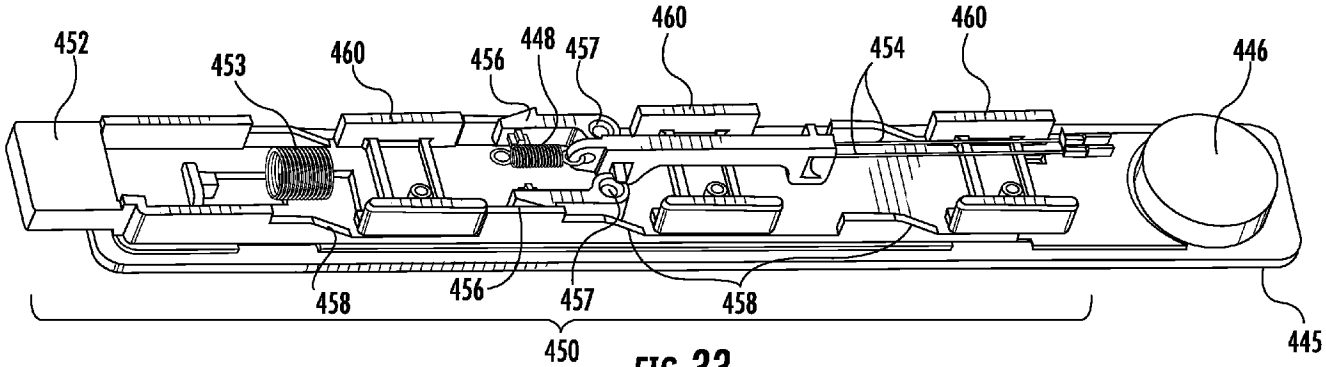
FIG. 33 is a top perspective view of the lock mechanism of FIG. 28 with the cover removed for purposes of clarity shown in the unlocked configuration.
Figure 34:
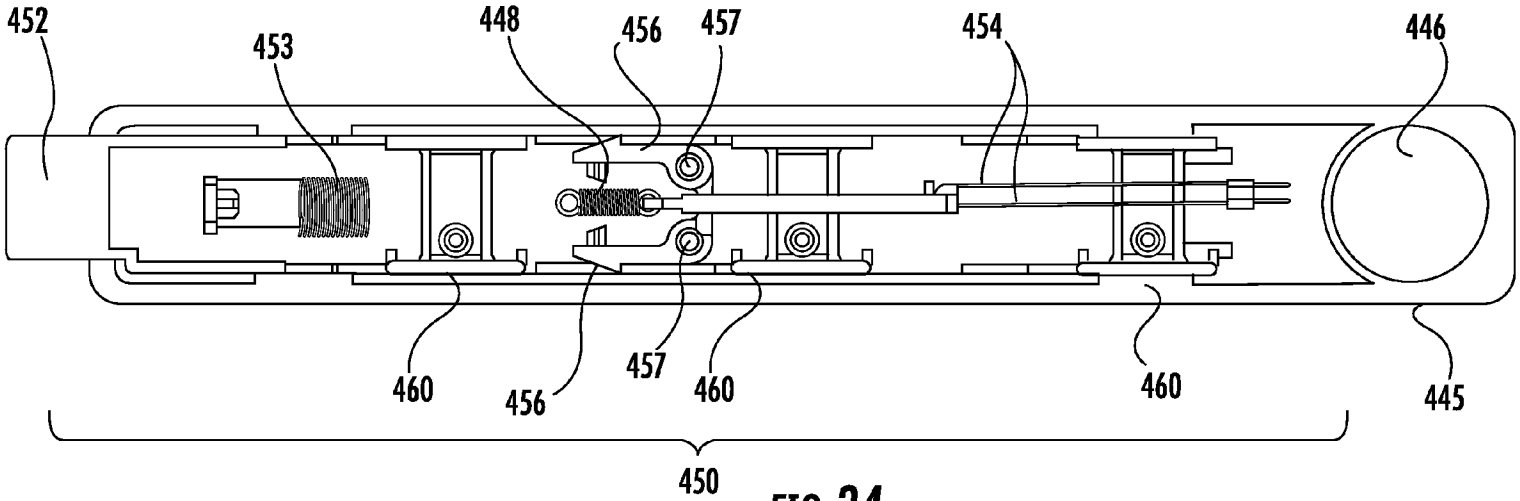
FIG. 34 is a top plan view of the lock mechanism of FIG. 28 with the cover removed for purposes of clarity shown in the unlocked configuration.

FIGS. 28, 29, and 32 show that in one embodiment the latch 445 may also include a plurality of retaining features 462 that are configured to receive and engage the engagement features 460. The retaining features 459 are configured to align with the retaining features 462 when the housing 420 is closed with respect to the lid 440. Thus, each engagement feature 460 may be configured to engage a respective retaining feature 459 and 462 in a locked configuration. The retaining features 462 may be spaced outwardly away from the plate 452. Thus, the housing 420 may be configured to engage the lid 440 such that a portion of the housing is positioned between the plate 452 and the retaining features 462.

The engagement features 460 and retaining features 459, 462 may be arranged in any suitable manner and include any desired number. In the illustrated embodiment, the retaining features 459 extend along a linear axis and are disposed on a lower edge proximate a front surface of the housing 420. Similarly, the engagement features 460 and/or retaining features 462 may extend along a linear axis on the latch 445 that is disposed adjacent a lower edge of the lid 440. FIGS. 30-31 and 33-34 show that the engagement features 460 may be engaged with the retaining features 459 via the movable latch 445. Where the latch 445 translates within a plane, the engagement features 460 are configured to move parallel to one another in a plane generally perpendicular to the plane of the latch. Moreover, FIGS. 28-34 show that the engagement features 460 and the retaining features 459, 462 have a generally rectangular cross section. However, the engagement features 460 and corresponding retaining features 459, 462 may have any desired shape (e.g., circular in cross section). As such, it is understood that the engagement features 460 may have a variety of sizes and configurations suitable for engaging correspondingly shaped retaining features 459, 462 defined in the housing 420 and/or the lid 440.

Figure 26:
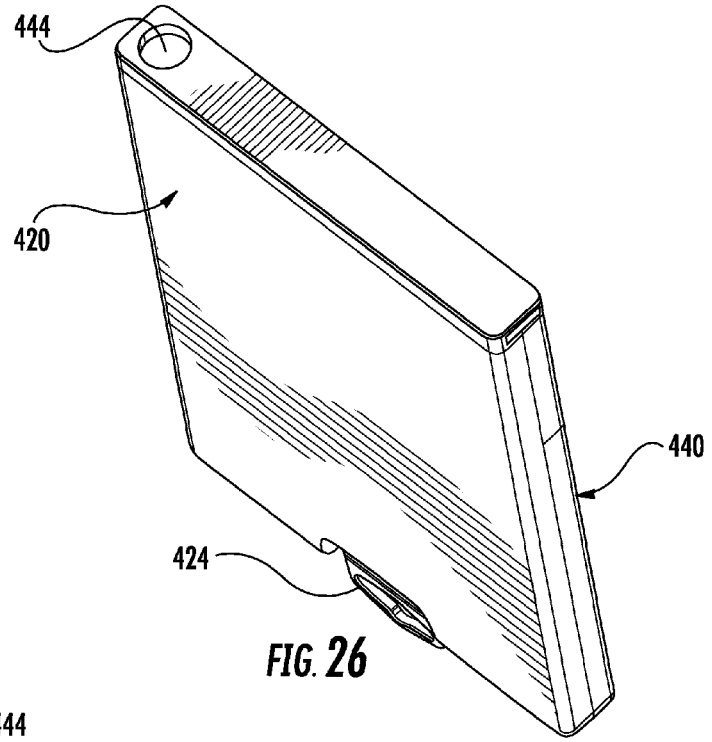
FIG. 26 is a bottom perspective view of the merchandise security device of FIG. 24 showing the security device in a locked configuration.
Figure 27:
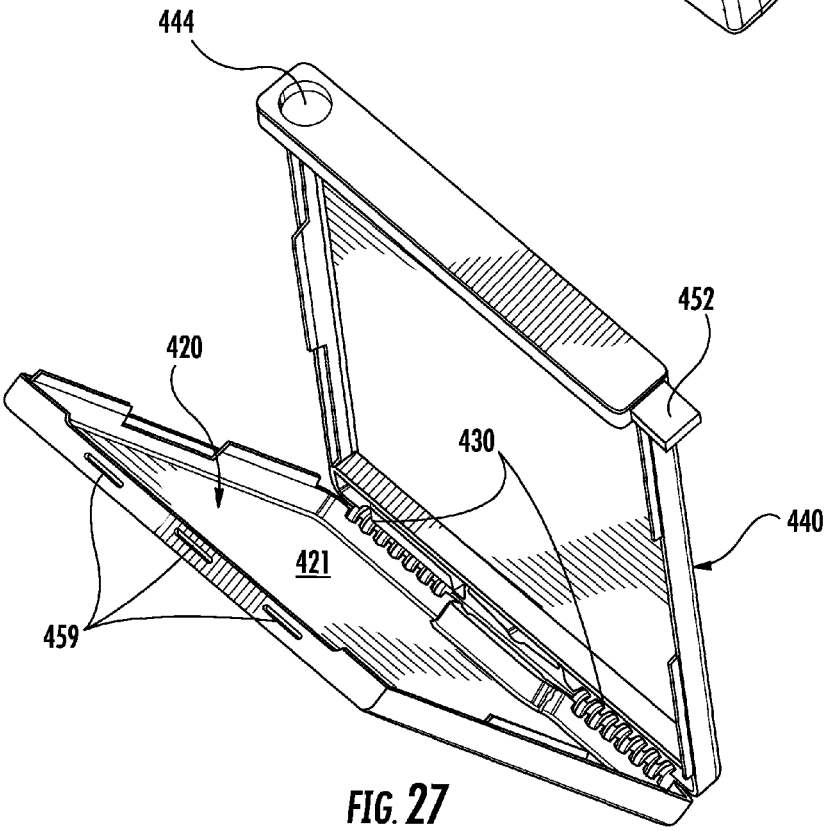
FIG. 27 is a bottom perspective view of the merchandise security device of FIG. 24 showing the security device in an unlocked configuration.

Furthermore, FIG. 26 and FIG. 27 show that the transfer port 444 may be located off center on the latch 445, illustrating that the transfer port may be provided at any desired location relative to the lock mechanism 450.

FIGS. 30-31 and 33-34 illustrate the lock mechanism 450 in more detail. In this regard, the lock mechanism 450 includes a slide mechanism 452 that is movable disposed on the latch 445. In the illustrated embodiment, the slide mechanism 452 is in the form of a generally planar plate that is configured to slide back and forth in a longitudinal direction relative to the latch 445. Plate 452 is inserted inwardly relative to latch 445 in the retracted (locked) configuration. The plate 452 may be inserted within the latch against the bias of a biasing member, for example, a linear, elastic spring 453. The lock mechanism 450 further comprises shape memory material 454 in the form of a Nitinol wire, as previously described. An inductive coil 446 disposed within or proximate to the transfer port 444 receives and transfers an electric current in the manner previously described. The inductive coil 446 is in electrical communication with and transmits the electrical current through the shape memory wire 454 resulting in contraction of the wire. Contraction of the wire 454 causes at least one, and as shown in the illustrated embodiment, a pair of retaining arms 456 to pivot inwardly about a pivot 457 and thereby release the plate 452 from the biasing force exerted by the spring 453. As a result, plate 452 slides outwardly relative to latch 445 from the retracted (locked) configuration to the extended (unlocked) configuration. As plate 452 slides outwardly to the extended (unlocked) configuration, cam surfaces 458 move away from engagement with the engagement features 460 and thereby release the engagement features from being biased upwardly relative to the plate. The engagement features 460 may move under the influence of gravity or be biased downwardly in the direction of the plate 452 of the latch 445 and out of engagement with the retaining features 459 provided on the housing 420 and retaining features 462 on the latch 445. In any case, the engagement features 460 are configured to extend and retract relative to the plate 452. With the engagement features 460 disengaged from the retaining features 459, the lid 440 can be moved relative to the housing 440, and more particularly, rotated about the pivot connection 430, to access the interior compartment 421 defined by the housing. When the lid 440 is closed on the housing 420, plate 452 may be manually moved inwardly relative to the latch 445 such that cam surfaces 458 move into engagement with the engagement features 460 and thereby bias the engagement features upwardly relative to the plate 452 into engagement with the retaining features 459 provided on the housing 420 and the retaining features 462 on the latch 445. Upon insertion of the plate 452, the retaining arms 456 may engage the plate to prevent the plate from being biased outwardly to the unlocked position. Thus, engagement between the retaining arms 456 and the plate 452 retains the plate in the locked position. If desired, movement of the plate 452 from the extracted (unlocked) configuration to the retracted (locked) configuration may be accomplished or at least assisted by, for example, a linear elastic spring 448. Regardless, with plate 452 in the retracted (locked) configuration (e.g., engagement features 460 biased into engagement with retaining features 459), the lid 440 cannot be rotated about the pivot connection 430 to access the interior compartment 421 defined by the housing 420.

It is understood that various configurations of lock mechanisms 450 may be employed with the latch 445. For example, although a pair of retaining arms 456 are shown, it is understood that one or more arms may be used. In addition, although linear motion of the shape memory material 454 causes pivoting of one or more retaining arms 456, contraction of the shape memory material may alternatively result in rotational motion for releasing the plate 452. Moreover, the shape memory material 454 and retaining arm(s) 456 may be located at any desired location relative to the plate 452.

The aforementioned "safer" type security devices 300, 400 may be formed of any desired material such as a clear polymeric material so that an item of merchandise can be seen through the housing. The housing may be any desired shape, such as a housing with a bottom surface and four sidewalls extending from the bottom surface to an open end. In addition, the housing may include a tapered wall thickness. For example, the sidewall thickness may increase progressively from the bottom surface towards the open end. The tapering sidewalls may be the front and rear sidewalls, while the lateral sidewalls are uniform in thickness. However, the entire sidewall may be tapered in some embodiments. In one non-limiting example, the sidewall thickness increases from about 2 mm to about 3 mm, with a draft of about 0.25 degrees on one surface and about 0.5 degrees on the opposing surface. The increased wall thickness may provide for more robust engagement between the engagement features and the retaining features, as well as at the pivotable connection. Furthermore, the bottom surface of the housing may include a curved surface, while the lid may be substantially flat. Thus, the bottom surface may be intended as the "top" of the security device so that the security device may rest on the lid. It is noted that use of the terms "bottom", "front", and "top" are not intended to be limiting and will depend on the orientation of the security device. In addition, it is understood that the top and/or bottom may include flat or curved surfaces. Flat surfaces on one or both of the top and bottom surfaces may facilitate stacking for storage when the security devices are not in use.

In other embodiments, the security device is an alarm stand, display, or module. For example, the security device may be similar to that disclosed in U.S. Pat. No. 7,740,214, entitled Display Having Self-Orienting Mounting Area, the disclosure of which is incorporated herein by reference in its entirety. The alarm stand may be operably engaged with a sensor, and the sensor may in turn be secured to an item of merchandise. The alarm stand may be operably engaged with the sensor via a cable extending between and coupled to each of the sensor and the alarm stand, while the sensor may be removably disposed on the alarm stand such that the sensor and the item of merchandise may be removed and replaced on the alarm stand.

In one embodiment, the alarm stand may include a lock mechanism similar to that discussed above that is configured to lock and/or unlock the sensor engaged with the item of merchandise via an electronic key. Thus, an authorized user may readily remove the sensor from the item of merchandise, unlike conventional systems that utilize mechanical fasteners. Similarly, the cable may be removably attached to the alarm stand and also or alternatively include a lock mechanism similar to that discussed above that allows the cable to be locked and/or unlocked from the alarm stand via an electronic key. For example, a connector on the end of the cable may be configured to cooperate with a lock mechanism in the alarm stand. In conventional systems, the cable may be readily removed by an unauthorized user and is typically not locked to the alarm stand.

In another embodiment, the security device may be configured to be locked to a support surface or device. For instance, a locking hook may be configured to lock to a support surface (e.g., pegboard or slat wall) and utilize a lock mechanism similar to that described above for locking and/or unlocking the locking hook from the support surface. Likewise, the security device may be configured to be locked or unlocked to a table, counter, shelf, wall, or the like and utilize a similar lock mechanism as discussed above that is operable via an electronic key.

Therefore, it is apparent that any number of security devices may be employed in conjunction with various forms of power transfer for actuating a lock mechanism (e.g., electrical, inductive, capacitive, etc.). For example, where a shape memory material is utilized, a change in shape of the shape memory material may cause mechanical actuation (e.g., linear and/or rotary movement) of the lock mechanism. The shape memory material may be operably engaged with a lock mechanism in any number of configurations to facilitate such actuation. Moreover, the shape memory material may be any suitable material, such as a metal, a polymer, or a combination thereof, that is configured to change its shape (e.g., length, area, etc.) in response to an electric current or a change in temperature and to return to its original shape after the electric current is no longer transferred therethrough. For example, transferring current through the shape memory material may cause the material to be heated and thereby contract. Upon removal of the current, the shape memory material may return to its original shape. In addition, other mechanisms may be utilized for actuating a lock mechanism, including mechanical, electrical, and/or chemical state changes. As such, the security devices and associated lock mechanisms should not be limited in light of the exemplary embodiments shown and described herein.

In some embodiments, the security device and the electronic key are similar to those disclosed in U.S. Patent Publication No. 2013/0081434, entitled Cabinet Lock for Use with Programmable Electronic Key and filed Sep. 28, 2012, U.S. Patent Publication No. 2012/0047972, entitled Electronic Key for Merchandise Security Device and filed Aug. 31, 2011, and U.S. Patent Publication No. 2011/0254661, entitled Programmable Security System and Method for Protecting Merchandise and filed Jun. 27, 2011, each of the disclosures of which is incorporated herein by reference in its entirety. In other embodiments, the security device and the electronic key are similar to those manufactured by InVue Security Products Inc. of Charlotte, N.C., USA, including the Plunger Locks, Smart Locks, and IR2 and IR2-S Keys.

The foregoing has described one or more exemplary embodiments of a merchandise display security system and method for use with an electronic key. Embodiments of a merchandise display security system have been shown and described herein for purposes of illustrating and enabling one of ordinary skill in the art to make, use and practice the invention. Those of ordinary skill in the art, however, will readily understand and appreciate that numerous variations and modifications of the invention may be made without departing from the spirit and scope thereof. Accordingly, all such variations and modifications are intended to be encompassed by the appended claims.

That which is claimed is:

1. A merchandise security system for protecting an item of merchandise from theft, comprising:

an electronic key configured to communicate data and transfer electrical power; and a merchandise security device comprising a lock mechanism that is configured to be operated by electrical power transferred from the electronic key to the lock mechanism, wherein the lock mechanism is operably engaged with a shape memory material that is configured to change in shape in response to receiving electrical power from the electronic key to thereby lock or unlock the lock mechanism, wherein the electronic key is configured to communicate data to the merchandise security device, wherein the merchandise security device is not configured to recognize the data, and wherein the electronic key is configured to transfer electrical power to the lock mechanism after transmitting the data to the merchandise security device and not receiving a return signal from the merchandise security device.

2. The merchandise security system of claim 1, wherein the electronic key is configured to transfer electrical power inductively to the lock mechanism.

3. The merchandise security system of claim 1, wherein the electronic key is configured to time out after a predetermined period of time.

4. The merchandise security system of claim 1, wherein the merchandise security device does not include at least one of a rectifier, a battery, or a logic control circuit to facilitate locking or unlocking thereof.

5. The merchandise security system of claim 1, further comprising at least one conductor operably engaged with the lock mechanism and in electrical communication with the shape memory material.

6. The merchandise security system of claim 5, wherein the at least one conductor comprises a coil having a plurality of continuous windings.

7. The merchandise security system of claim 1, wherein the shape memory material comprises a wire in electrical communication with the lock mechanism.

8. The merchandise security system of claim 7, wherein the shape memory material is configured to change in length in response to the at least one conductor receiving electrical power.

9. The merchandise security system of claim 1, wherein the electronic key is configured to transfer electrical power wirelessly.

10. The merchandise security system of claim 1, wherein the merchandise security device comprises:

a container defining an enclosure configured to receive the item of merchandise therein; and a lid pivotally engaged with the container and configured to pivot between open and closed positions relative to the container, wherein the lock mechanism is operably engaged with the lid or the container and is operable to lock the lid to the container in the closed position, and wherein the shape memory material is configured to change in shape in response to receiving electrical power for unlocking the lid from the container so that the item of merchandise may be removed from the container in the open position.

11. The merchandise security system of claim 10, wherein the lock mechanism is operably engaged with the lid.

12. The merchandise security system of claim 1, wherein the merchandise security device further comprises a locking hook configured to be secured to a display surface, the locking hook comprising at least one rod for supporting items of merchandise thereon and a housing configured to releasably engage the at least one rod in response to actuation of the lock mechanism, wherein the housing contains the lock mechanism and is configured to be engaged to the at least one rod when the lock mechanism is in a locked configuration and disengaged from the at least one rod when the lock mechanism is in an unlocked configuration.

13. The merchandise security system of claim 1, wherein the merchandise security device further comprises a housing configured to releasably engage, and be removed from, at least one rod in response to actuation of the lock mechanism, wherein the housing contains the lock mechanism and is configured to be engaged to the at least one rod when the lock mechanism is in a locked configuration and disengaged from the at least one rod when the lock mechanism is in an unlocked configuration, and wherein the at least one rod is configured to be secured to a display surface for supporting items of merchandise thereon.

14. The merchandise security system of claim 1, wherein the data comprises a security disarm code.

15. The merchandise security system of claim 1, wherein the merchandise security device does not include an alarm circuit.

16. The merchandise security system of claim 1, wherein no compressive and/or torsional force is exerted by the electronic key on the lock mechanism in order to lock or unlock the lock mechanism.

17. The merchandise security system of claim 1, further comprising a second merchandise security device configured to communicate with the electronic key for authorizing operation of the second merchandise security device, wherein the electronic key is configured to transfer electrical power to the lock mechanism after determining that the merchandise security device is an authorized device.

18. A method for protecting an item of merchandise susceptible to theft, comprising:

receiving data from an electronic key at a merchandise security device, wherein the merchandise security device is not configured to recognize the data and comprises a lock mechanism;

receiving electrical power from the electronic key at the merchandise security device after receiving the data and not receiving a return signal from the merchandise security device; and locking or unlocking the lock mechanism in response to a change in shape of a shape memory material operably engaged with the lock mechanism.

19. The method of claim 18, wherein receiving electrical power comprises receiving electrical power inductively.

20. The method of claim 18, wherein receiving data comprises receiving a security disarm code.

* * * * *